US010295930B2

(12) United States Patent
Shiraishi et al.

(10) Patent No.: US 10,295,930 B2
(45) Date of Patent: May 21, 2019

(54) APPLIED VOLTAGE CONTROL DEVICE, IMAGE FORMING APPARATUS, METHOD, AND NON-TRANSITORY COMPUTER-READABLE STORAGE MEDIUM THAT CONTROL AN ALTERNATING CURRENT DEVELOPMENT VOLTAGE APPLIED TO MOVE A DEVELOPER

(71) Applicants: Emiko Shiraishi, Tokyo (JP); Hiroaki Kuwabara, Kanagawa (JP)

(72) Inventors: Emiko Shiraishi, Tokyo (JP); Hiroaki Kuwabara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/291,320

(22) Filed: Oct. 12, 2016

(65) Prior Publication Data

US 2017/0115593 A1 Apr. 27, 2017

(30) Foreign Application Priority Data

Oct. 23, 2015 (JP) ..... 2015-209350

(51) Int. Cl.
*G03G 15/06* (2006.01)

(52) U.S. Cl.
CPC ..... *G03G 15/065* (2013.01)

(58) Field of Classification Search
CPC ..... G03G 15/065
USPC ..... 399/55
See application file for complete search history.

(56) References Cited

U.S. PATENT DOCUMENTS

2005/0196189 A1* 9/2005 Matsuura ..... G03G 15/065 399/55

FOREIGN PATENT DOCUMENTS

JP 5-257369 10/1993
JP 2016-021043 2/2018

OTHER PUBLICATIONS

Computer translation of cited reference JP2016-021043A to Shiraishi; Apr. 2016.*

* cited by examiner

*Primary Examiner* — Quana Grainger
(74) *Attorney, Agent, or Firm* — Oblon, McClelland, Maier & Neustadt, L.L.P.

(57) ABSTRACT

An applied voltage control device includes a potential difference determiner and an applied voltage controller. The potential difference determiner determines a potential difference between a maximum alternating current development voltage and a minimum alternating current development voltage, depending on a developing potential that is an absolute value of a difference between an average electric potential of an alternating current development and an electric potential of a latent image, so as to maintain a constant maximum voltage of a developing bias in the alternating current development. The applied voltage controller controls an alternating current development voltage, applied to move developer from a developer bearer to the latent image, so as to obtain the potential difference determined by the potential difference determiner.

9 Claims, 21 Drawing Sheets

FIG. 15A
FIG. 15 | FIG. 15A | FIG. 15B | FIG. 15C
| | Duty=$\alpha_1$% |
|---|---|
| Vpp=$P_1$V | — |
| Vpp=$P_3$V | 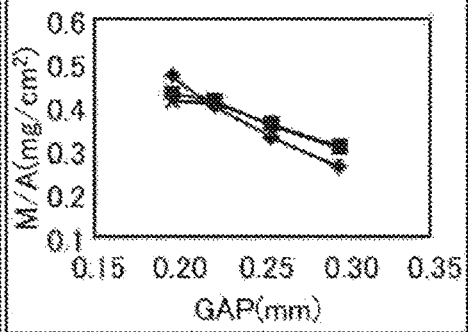  |
| Vpp=$P_5$V | 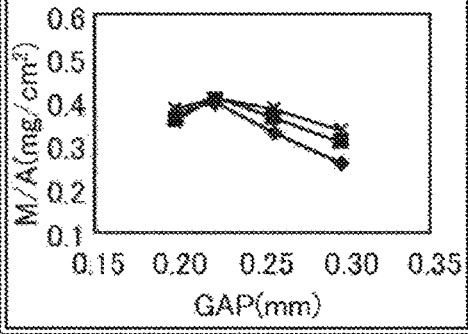  |
| Vpp=$P_6$V | 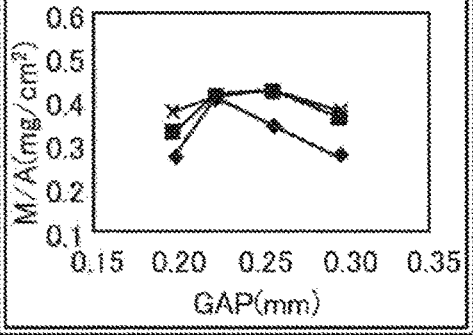  |

FIG. 16

| CHARGED AMOUNT OF TONER ($\mu$C/g) | TONER DENSITY (wt%) | | | | |
|---|---|---|---|---|---|
| | $S_1$ | $S_2$ | $S_3$ | $S_4$ | $S_5$ |
| $E_1$ | – | Duty=$\alpha_8$% Vpp=$P_3$V | – | Duty=$\alpha_6$% Vpp=$P_2$V | – |
| $E_2$ | Duty=$\alpha_7$% Vpp=$P_4$V | – | Duty=$\alpha_7$% Vpp=$P_3$V | – | Duty=$\alpha_5$% Vpp=$P_1$V |
| $E_3$ | – | Duty=$\alpha_6$% Vpp=$P_3$V | – | Duty=$\alpha_4$% Vpp=$P_2$V | – |
| $E_4$ | Duty=$\alpha_6$% Vpp=$P_4$V | – | Duty=$\alpha_5$% Vpp=$P_3$V | – | Duty=$\alpha_3$% Vpp=$P_2$V |
| $E_5$ | – | Duty=$\alpha_5$% Vpp=$P_3$V | – | Duty=$\alpha_3$% Vpp=$P_2$V | – |
| $E_6$ | Duty=$\alpha_5$% Vpp=$P_5$V | – | Duty=$\alpha_3$% Vpp=$P_3$V | – | Duty=$\alpha_2$% Vpp=$P_2$V |
| $E_7$ | – | Duty=$\alpha_4$% Vpp=$P_4$V | – | Duty=$\alpha_2$% Vpp=$P_2$V | – |
| $E_8$ | – | – | Duty=$\alpha_2$% Vpp=$P_3$V | – | – |

FIG. 18

| CHARGED AMOUNT OF TONER ($\mu$C/g) | TONER DENSITY (wt%) | | | | |
|---|---|---|---|---|---|
| DEVELOPING $\gamma$ (mg/cm$^2$ · V) | $S_1$ | $S_2$ | $S_3$ | $S_4$ | $S_5$ |
| $\gamma_1$ | – | – | – | $E_1$ | $E_2$ |
| $\gamma_2$ | – | $E_1$ | $E_2$ | $E_3$ | $E_4$ |
| $\gamma_3$ | $E_2$ | $E_3$ | $E_4$ | $E_5$ | $E_6$ |
| $\gamma_4$ | $E_4$ | $E_5$ | $E_6$ | $E_7$ | – |
| $\gamma_5$ | $E_6$ | $E_7$ | $E_8$ | – | – |

FIG. 19

| CHARGED AMOUNT OF TONER ($\mu$C/g) | DEVELOPING $\gamma$ (mg/cm$^2$ · V) | | | | |
|---|---|---|---|---|---|
| | $\gamma_1$ | $\gamma_2$ | $\gamma_3$ | $\gamma_4$ | $\gamma_5$ |
| $E_1$ | Duty=$\alpha_6$%<br>Vpp=$P_2$V | Duty=$\alpha_8$%<br>Vpp=$P_3$V | – | – | – |
| $E_2$ | Duty=$\alpha_5$%<br>Vpp=$P_1$V | Duty=$\alpha_7$%<br>Vpp=$P_3$V | Duty=$\alpha_7$%<br>Vpp=$P_4$V | – | – |
| $E_3$ | – | Duty=$\alpha_4$%<br>Vpp=$P_2$V | Duty=$\alpha_6$%<br>Vpp=$P_3$V | – | – |
| $E_4$ | – | Duty=$\alpha_3$%<br>Vpp=$P_2$V | Duty=$\alpha_5$%<br>Vpp=$P_3$V | Duty=$\alpha_6$%<br>Vpp=$P_4$V | – |
| $E_5$ | – | – | Duty=$\alpha_3$%<br>Vpp=$P_2$V | Duty=$\alpha_5$%<br>Vpp=$P_3$V | – |
| $E_6$ | – | – | Duty=$\alpha_2$%<br>Vpp=$P_2$V | Duty=$\alpha_3$%<br>Vpp=$P_3$V | Duty=$\alpha_5$%<br>Vpp=$P_5$V |
| $E_7$ | – | – | – | Duty=$\alpha_2$%<br>Vpp=$P_2$V | Duty=$\alpha_4$%<br>Vpp=$P_4$V |
| $E_8$ | – | – | – | – | Duty=$\alpha_2$%<br>Vpp=$P_3$V |

FIG. 20

| | TONER DENSITY (wt%) | | | | |
|---|---|---|---|---|---|
| DEVELOPING $\gamma$ (mg/cm$^2$ · V) | $S_1$ | $S_2$ | $S_3$ | $S_4$ | $S_5$ |
| $\gamma_1$ | – | | | Duty=$\alpha_6$%<br>Vpp=$P_2$V | Duty=$\alpha_5$%<br>Vpp=$P_1$V |
| $\gamma_2$ | – | Duty=$\alpha_8$%<br>Vpp=$P_3$V | Duty=$\alpha_7$%<br>Vpp=$P_3$V | Duty=$\alpha_4$%<br>Vpp=$P_2$V | Duty=$\alpha_3$%<br>Vpp=$P_2$V |
| $\gamma_3$ | Duty=$\alpha_7$%<br>Vpp=$P_4$V | Duty=$\alpha_6$%<br>Vpp=$P_3$V | Duty=$\alpha_5$%<br>Vpp=$P_3$V | Duty=$\alpha_3$%<br>Vpp=$P_2$V | Duty=$\alpha_2$%<br>Vpp=$P_2$V |
| $\gamma_4$ | Duty=$\alpha_6$%<br>Vpp=$P_4$V | Duty=$\alpha_5$%<br>Vpp=$P_3$V | Duty=$\alpha_3$%<br>Vpp=$P_3$V | Duty=$\alpha_2$%<br>Vpp=$P_2$V | – |
| $\gamma_5$ | Duty=$\alpha_5$%<br>Vpp=$P_5$V | Duty=$\alpha_4$%<br>Vpp=$P_4$V | Duty=$\alpha_2$%<br>Vpp=$P_3$V | – | – |

APPLIED VOLTAGE CONTROL DEVICE, IMAGE FORMING APPARATUS, METHOD, AND NON-TRANSITORY COMPUTER-READABLE STORAGE MEDIUM THAT CONTROL AN ALTERNATING CURRENT DEVELOPMENT VOLTAGE APPLIED TO MOVE A DEVELOPER

CROSS-REFERENCE TO RELATED APPLICATION

This patent application is based on and claims priority pursuant to 35 U.S.C. § 119(a) to Japanese Patent Application No. 2015-209350, filed on Oct. 23, 2015, in the Japan Patent Office, the entire disclosure of which is hereby incorporated by reference herein.

BACKGROUND

Technical Field

Embodiments of the present disclosure generally related to an applied voltage control device, an image forming apparatus, a method of controlling an applied voltage, and a non-transitory computer-readable storage medium storing an applied voltage control program, and more particularly, to an applied voltage control device for controlling an applied voltage, an image forming apparatus for forming an image on a recording medium, a method of controlling an applied voltage, and a non-transitory computer-readable storage medium storing an applied voltage control program for controlling an applied voltage.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, the image is formed on the recording medium.

Such electrophotographic image forming apparatuses often include a developing roller that rotates while bearing toner on the surface of the developing roller due to electrostatic attraction produced by an internally generated magnetic force to transfer the toner to a development zone where the developing roller faces an image bearer such as a photoconductor to develop an electrostatic latent image with the toner.

SUMMARY

In one embodiment of the present disclosure, a novel applied voltage control device is described that includes a potential difference determiner and an applied voltage controller. The potential difference determiner determines a potential difference between a maximum alternating current development voltage and a minimum alternating current development voltage, depending on a developing potential that is an absolute value of a difference between an average electric potential of an alternating current development and an electric potential of a latent image, so as to maintain a constant maximum voltage of a developing bias in the alternating current development. The applied voltage controller controls an alternating current development voltage, applied to move developer from a developer bearer to the latent image, so as to obtain the potential difference determined by the potential difference determiner.

Also described is a novel image forming apparatus incorporating the applied voltage control device.

Also described is a novel method of controlling an applied voltage. The method includes determining a potential difference between a maximum alternating current development voltage and a minimum alternating current development voltage, depending on a developing potential that is an absolute value of a difference between an average electric potential of an alternating current development and an electric potential of a latent image, so as to maintain a constant maximum voltage of a developing bias in the alternating current development, and controlling an alternating current development voltage, applied to move developer from a developer bearer to the latent image, so as to obtain the potential difference determined.

Also described is a novel non-transitory, computer-readable storage medium storing an applied voltage control program which, when executed by a processor, performs a method of controlling an applied voltage. The storage medium includes determining a potential difference between a maximum alternating current development voltage and a minimum alternating current development voltage, depending on a developing potential that is an absolute value of a difference between an average electric potential of an alternating current development and an electric potential of a latent image, so as to maintain a constant maximum voltage of a developing bias in the alternating current development; and controlling an alternating current development voltage, applied to move developer from a developer bearer to the latent image, so as to obtain the potential difference determined.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein:

FIGS. 15A to 15C are graphs illustrating changes in amount of toner adhering to the surface of the photoconductive drum per unit area for each combination of duty and potential difference when the bias upon development is applied to the developing roller to develop an electrostatic latent image in the image forming apparatus of FIG. 1;

FIG. 16 is an example of duty-Vpp determination table according to an embodiment of the present disclosure;

FIG. 18 is an example of charged-toner-amount determination table according to an embodiment of the present disclosure;

FIG. 19 is another example of duty-Vpp determination table according to an embodiment of the present disclosure;

FIG. 20 is yet another example of duty-Vpp determination table according to an embodiment of the present disclosure;

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
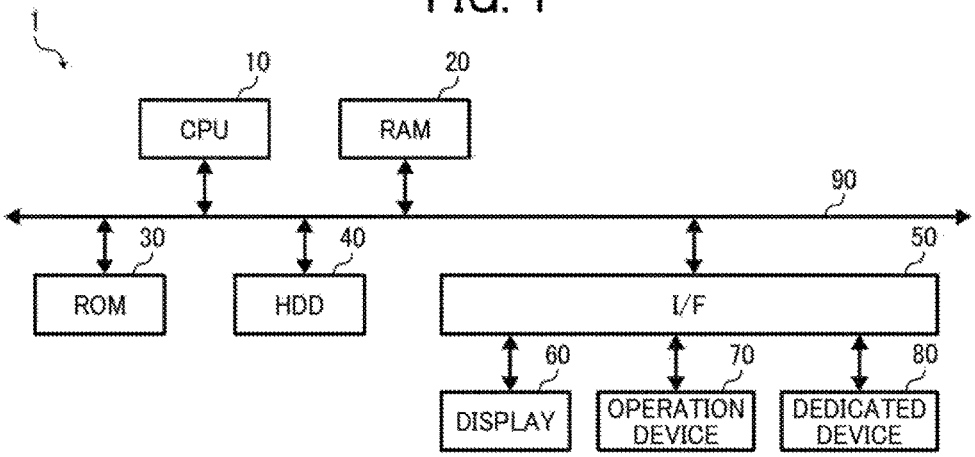
FIG. 1 is a schematic block diagram of a hardware structure of an image forming apparatus according to an embodiment of the present disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes C, M, Y, and K denote colors cyan, magenta, yellow, and black, respectively. To simplify the description, these suffixes are omitted unless necessary.

Referring now to the drawings, embodiments of the present disclosure are described below. Initially with reference to FIG. 1, a description is given of a hardware structure of an image forming apparatus 1 according to an embodiment of the present disclosure.

FIG. 1 is a schematic block diagram of the hardware structure of the image forming apparatus 1.

In addition to the hardware structure illustrated in FIG. 1, the image forming apparatus 1 includes an engine with which the image forming apparatus 1 is implemented as a printer, a scanner, and a facsimile machine.

As illustrated in FIG. 1, the image forming apparatus 1 has a structure similar to a general server or personal computer. Specifically, the image forming apparatus 1 includes a central processing unit (CPU) 10, a random access memory (RAM) 20, a read only memory (ROM) 30, a hard disk drive (HDD) 40, and an interface (I/F) 50 operatively connected to each other through a bus 90. The I/F 50 is connected to a display 60, an operation device 70, and a dedicated device 80.

The CPU 10 is a calculator, and controls overall operation of the image forming apparatus 1. The RAM 20 is a volatile storage medium that allows data to be read or written at a relatively high speed. The RAM 20 is used as an operation area for the CPU 10 to process the data. The ROM 30 is a non-volatile, read-only storage medium that stores a program such as a firmware. The HDD 40 is a non-volatile storage medium that allows data to be read or written. The HDD 40 stores, e.g., an operation system (OS), various control programs such as an applied voltage control program, and application programs.

The I/F 50 connects the bus 90 to various hardware components or networks for control. The display 60 is a visual interface for confirming the status of the image forming apparatus 1. The display 60 is implemented as a display device such as a liquid crystal display (LCD). The operation device 70 is a user interface, such as a key board and a mouse, for inputting data to the image forming apparatus 1. The dedicated device 80 is hardware to implement dedicated functions in the printer, the scanner, and the facsimile machine.

In such a hardware structure, the RAM 20 reads a program stored in a storage medium such as the ROM 30, the HDD 40, or an optical disk. The CPU 10 executes calculation according to the program loaded into the RAM 20, thereby constructing a software controller. The software controller and the hardware constructs functional blocks that implement functions of the image forming apparatus 1.

Figure 2:
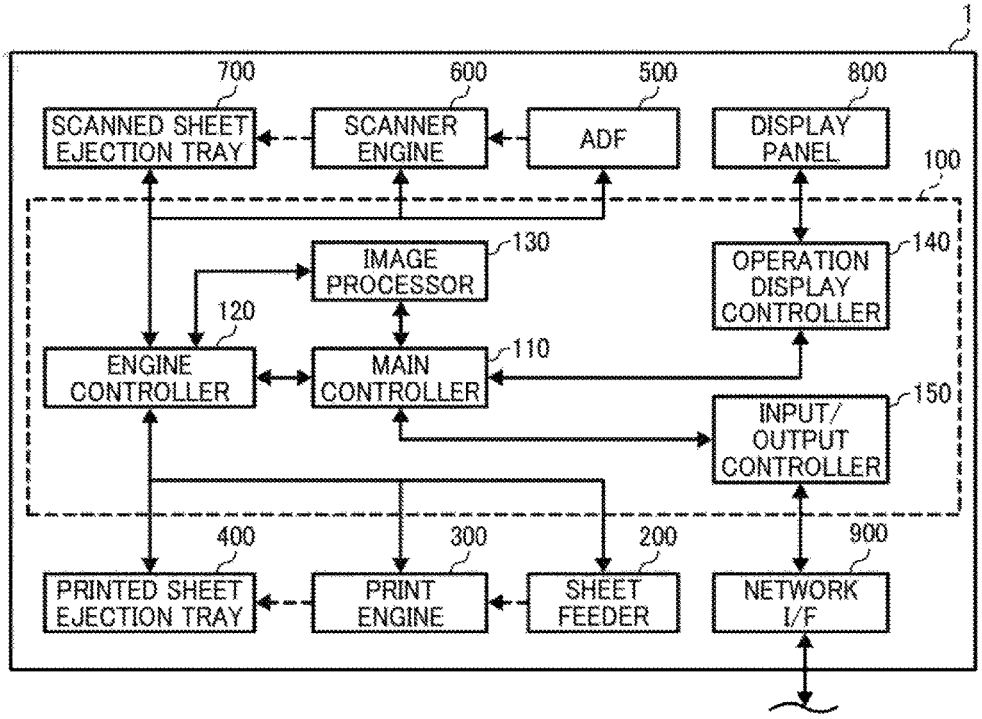
FIG. 2 is a schematic block diagram of a functional structure of the image forming apparatus of FIG. 1.

Referring now to FIG. 2, a description is given of a functional structure of the image forming apparatus 1.

FIG. 2 is a schematic block diagram of the functional structure of the image forming apparatus 1.

In FIG. 2, an electric connection is indicated by a solid arrow, and movement of a recording medium such as a transfer sheet or a document is indicated by a broken arrow.

As illustrated in FIG. 2, the image forming apparatus 1 includes a controller 100, a sheet feeder 200, a print engine 300, a printed-sheet ejection tray 400, an automatic document feeder (ADF) 500, a scanner engine 600, a scanned-sheet ejection tray 700, a display panel 800, and a network interface (I/F) 900. The controller 100 includes a main controller 110, an engine controller 120, an image processor 130, an operation display controller 140, and an input/output controller 150.

The sheet feeder 200 feeds a recording medium such as a transfer sheet to the print engine 300. The print engine 300 is an image forming device that forms an image on the recording medium fed by the sheet feeder 200. Specifically, the print engine 300 forms an image by electrophotography. The recording medium bearing the image is ejected onto the printed-sheet ejection tray 400. The print engine 300 is implemented by the dedicated device 80 illustrated in FIG. 1.

The ADF 500 automatically feeds a document to the scanner engine 600. The scanner engine 600 is a document reader or scanner that includes a photovoltaic device that converts optical data to electrical signals. The scanner engine 600 optically scans the document thus fed by the ADF 500 or a document placed on a glass platen to generate image data. The document thus fed by the ADF 500 and scanned by the scanner engine 600 is ejected onto the scanned-sheet ejection tray 700. The ADF 500 and the scanner engine 600 are implemented by the dedicated device 80 illustrated in FIG. 1.

The display panel 800 is an output interface that visually displays the status of the image forming apparatus 1, and is an input interface as a touch panel to directly receive a manual operation directed to the image forming apparatus 1 or to receive information to the image forming apparatus 1. That is, the display panel 800 includes a function of displaying an image to receive the manual operation. The display panel 800 is implemented by the display 60 and the operation device 70 illustrated in FIG. 1.

The network I/F 900 is an interface that allows the image forming apparatus 1 to communicate with other devices, such as an administrator terminal and a personal computer, via a network. The network I/F 900 may be, e.g., an Ethernet (registered trademark), a universal serial bus (USB) interface, a Bluetooth (registered trademark), a Wireless Fidelity or Wi-Fi (registered trademark), or a FeliCa (registered trademark). The image forming apparatus 1 receives, e.g., data of an image to be printed and various control commands such as a print request from a terminal connected via the network VF 900. The network/F 900 is implemented by the I/F 50 illustrated in FIG. 1.

The controller 100 is constructed of software and hardware. Specifically, a control program such as a firmware, stored in the non-volatile storage medium such as the ROM 30 and the HDD 40, is loaded into the RAM 20. The CPU 10 executes calculation according to the program, thereby constructing the software controller. The controller 100 is constructed of the software controller and hardware such as an integrated circuit. The controller 100 serves as a controller that controls the entire image forming apparatus 1. Therefore, in the present embodiment, the controller 100 serves as an applied voltage control device.

The main controller 110 serves as a controller that controls various components included in the controller 100. The main controller 110 instructs the various components of the controller 100. In addition, the main controller 110 controls the input/output controller 150 to access the other devices via the network I/F 900 and the network. The engine controller 120 controls or drives drivers such as the print engine 300 and the scanner engine 600.

According to control by the main controller 110, the image processor 130 generates image forming data as output data according to image data described in, e.g., a page description language (PDL) such as document data or image data included in an input print job. The image forming data is, e.g., bitmap data of cyan, magenta, yellow, and black. According to the data, the print engine 300 as an image forming device forms an image.

The image processor 130 processes imaging data input from the scanner engine 600 and generates image data. The image data is stored in the image forming apparatus 1 as a result of scanning, or transmitted to another device via the network I/F 900 and the network. Instead of the image data, the image forming data may be directly input to the image forming apparatus 1. In such a case, the image forming apparatus 1 forms an image according to the image forming data thus input.

The operation display controller 140 displays data on the display panel 800, or notifies the main controller 110 of data input through the display panel 800. The input/output controller 150 inputs a signal or an instruction input through the network I/F 900 and the network to the main controller 110.

Figure 3:
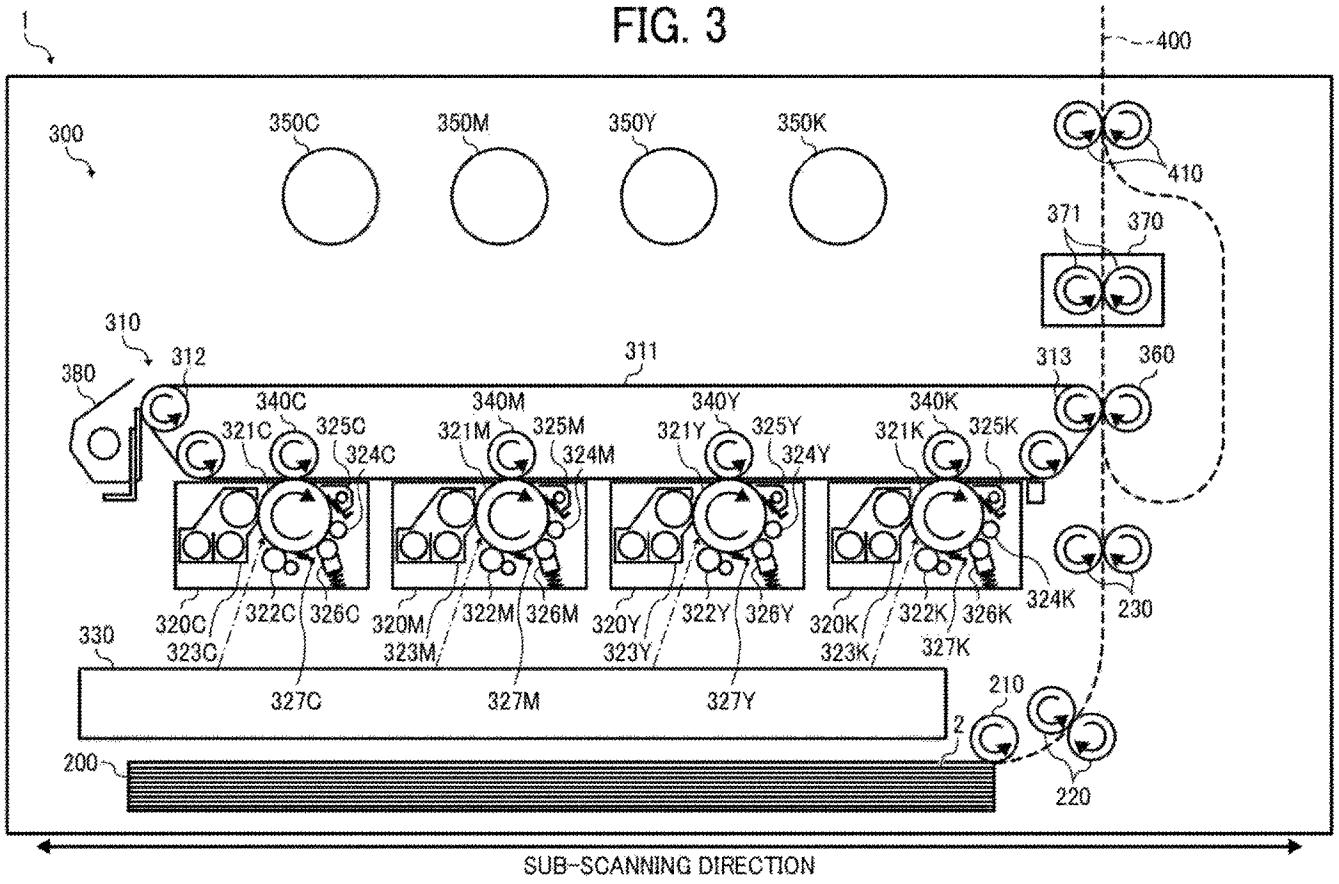
FIG. 3 is a cross-sectional view of the image forming apparatus of FIG. 1 in a sub-scanning direction.
Figure 4:
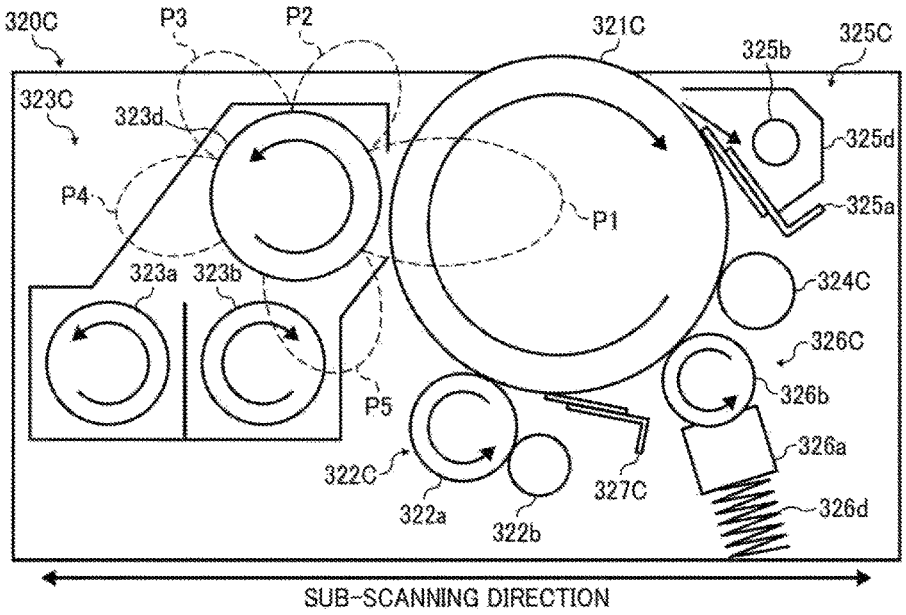
FIG. 4 is a cross-sectional view of an image forming unit incorporated in the image forming apparatus of FIG. 1 in the sub-scanning direction.
Figure 5:
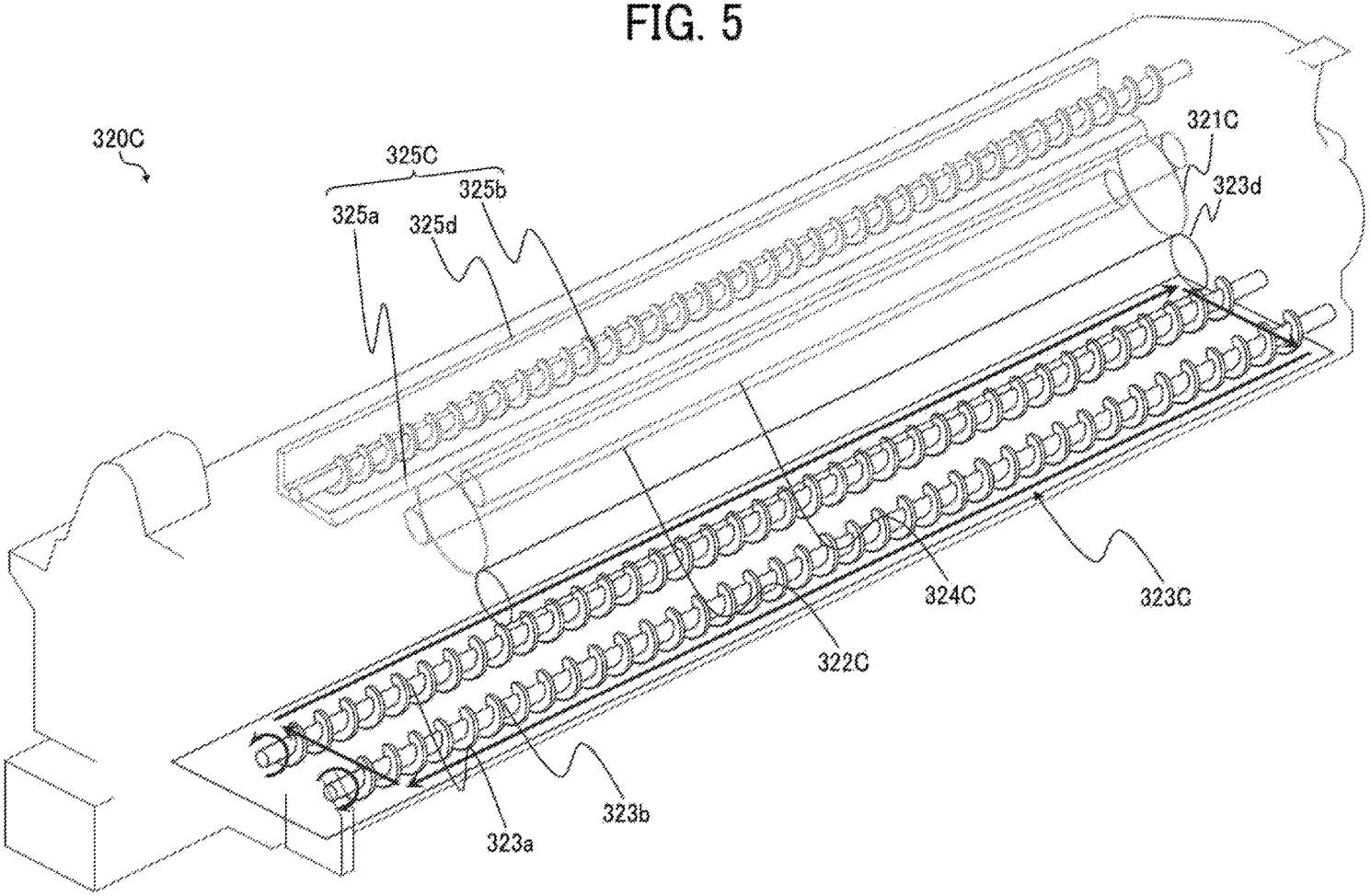
FIG. 5 is a perspective view from above of the image forming unit of FIG. 4.

Referring now to FIGS. 3 through 5, a detailed description is given of the print engine 300.

FIG. 3 is a cross-sectional view of the image forming apparatus 1 in a sub-scanning direction. FIG. 4 is a cross-sectional view of an image forming unit 320C incorporated in the image forming apparatus 1 in the sub-scanning direction. FIG. 5 is a perspective view from above of the image forming unit 320C of FIG. 4.

As illustrated in FIG. 3, in the image forming apparatus 1, the sheet feeder 200 feeds a recording medium 2, such as a transfer sheet, to the print engine 300. The print engine 300 forms an image on the recording medium 2. Then, the recording medium 2 is ejected onto the printed-sheet ejection tray 400.

The print engine 300 includes a conveyor unit 310 and image forming units 320 for cyan, magenta, yellow, and black. The print engine 300 has a tandem configuration in which the image forming units 320 are arranged side by side along the conveyor unit 310. The conveyor unit 310 includes an endless intermediate transfer belt 311 and a plurality of support rollers, such as a drive roller 312 and a driven roller 313. The intermediate transfer belt 311 is entrained around the plurality of support rollers. In FIG. 3, the image forming units 320 are illustrated as image forming units 320C, 320M, 320Y, and 320K for cyan, magenta, yellow, and black, respectively. The image forming units 320C, 320M, 320Y, and 320K are arranged side by side in this order from an upstream side in a rotational direction of the intermediate transfer belt 311.

The image forming units 320C, 320M, 320Y, and 320K have identical configurations while forming toner images of different colors. Specifically, the image forming units 320C, 320M, 320Y, and 320K form toner images of cyan, magenta, yellow, and black, respectively. Since the image forming units 320C, 320M, 320Y, and 320K have identical configurations, a detailed description is given of the image forming unit 320C hereinafter as a representative of the image forming units 320.

The intermediate transfer belt 311 is made of a heat-resistant material such as polyimide or polyamide. The intermediate transfer belt 311 is an endless belt entrained around the plurality of support rollers such as the driven roller 313 and the drive roller 312 driven to rotate. Each of the image forming units 320C, 320M, 320Y, and 320K forms a toner image as an intermediate transfer image on the intermediate transfer belt 311. A drive motor rotates the drive roller 312, thereby rotating the other support rollers including the driven roller 313, resulting in rotation of the intermediate transfer belt 311.

The image forming unit 320C forms a toner image of cyan, as an intermediate transfer image, on the intermediate transfer belt 311. As illustrated in FIGS. 4 and 5, the image forming unit 320C includes a photoconductive drum 321C as a photoconductor and various pieces of equipment surrounding the photoconductive drum 321C such as a charging unit 322C, a developing unit 323C, a neutralizer 324C, a toner collection unit 325C, a lubricant application unit 326C, and a lubricant leveling blade 327C. The photoconductive drum 321C, the charging unit 322C, the developing unit 323C, the neutralizer 324C, the toner collection unit 325C, the lubricant application unit 326C, and the lubricant leveling blade 327C may be individual pieces of equipment constructing the image forming unit 320C. Alternatively, at least one of the various pieces of equipment surrounding the photoconductive drum 321C may be integrally formed with the photoconductive drum 321C, constructing a process cartridge removable from the image forming apparatus 1. FIGS. 4 and 5 illustrate enlarged views of the image forming unit 320C of FIG. 3.

Before a toner image of cyan is formed, in the image forming unit 320C, the lubricant application unit 326C applies lubricant onto the surface of the photoconductive drum 321C. The lubricant leveling blade 327C levels the lubricant thus applied to a predetermined thickness and fixes the lubricant onto the surface of the photoconductive drum 321C.

Thus, the lubricant is applied onto the surface of the photoconductive drum 321C before the toner image of cyan is formed to decrease a coefficient of friction at an area of contact between the surface of the photoconductive drum 321C and a mechanism that contacts the surface of the photoconductive drum 321C, so as to reduce attrition at the area of contact. In addition, the lubricant thus applied before the toner image of cyan is formed enhances the efficiency with which the toner collection unit 325C collects residual toner from the surface of the photoconductive drum 321C. Further, the lubricant thus applied before the toner image of cyan is formed prevents generation of friction sound between the surface of the photoconductive drum 321C and an edge of a cleaning blade.

Furthermore, the lubricant thus applied before the toner image of cyan is formed protects the surface of the photoconductive drum 321C from an electrical current that may exhaust the surface of the photoconductive drum 321C when the charging unit 322C charges the surface of the photoconductive drum 321C.

Time and operation of the photoconductive drum 321C may degrade or exhaust the lubricant thus applied onto the surface of the photoconductive drum 321C. In such a case, the lubricant application unit 326C supplies the lubricant to maintain a steady effect of applying the lubricant onto the surface of the photoconductive drum 321C.

As specifically illustrated in FIG. 4, the lubricant application unit 326C is disposed downstream from the toner collection unit 325C and upstream from the developing unit 323C in a rotational direction of the photoconductive drum 321C. The lubricant application unit 326C includes a solid lubricant 326*a*, a lubricant application roller 326*b*, and a solid lubricant pressing spring 326*d*.

The lubricant application roller 326*b* is disposed opposite the photoconductive drum 321C. The lubricant application roller 326*b* rotates while contacting the photoconductive drum 321C and the solid lubricant 326*a*, thereby scraping the solid lubricant 326*a* and applying the solid lubricant 326*a* thus scraped to the photoconductive drum 321C. The solid lubricant pressing spring 326*d* is a compression spring that generates a pressing force to press the solid lubricant 326*a* to the lubricant application roller 326*b*.

After the lubricant is applied onto the surface of the photoconductive drum 321C, the image forming unit 320C forms a toner image of cyan, as an intermediate transfer image, on the intermediate transfer belt 311. Specifically, at first, the charging unit 322C uniformly charges the surface of the photoconductive drum 321C. Then, an optical writing device 330, illustrated in FIG. 3, emits light corresponding to a cyan image to the charged surface of the photoconductive drum 321C, thereby writing on the surface of the photoconductive drum 321C by static electricity. Thus, an electrostatic latent image corresponding to the cyan image is formed on the surface of the photoconductive drum 321C.

As illustrated in FIG. 4, the charging unit 322C includes a charging roller 322*a* and a charging roller cleaner 322*b*. A charging bias is applied to the charging roller 322*a* that is disposed nearby the surface of the photoconductive drum 321C, thereby uniformly charging the surface of the photoconductive drum 321C.

The charging roller cleaner 322*b* contacts the charging roller 322*a* to remove a contaminant from the surface of the charging roller 322*a*. If the surface of the charging roller 322*a* is contaminated, the contaminant on the surface of the charging roller 322*a* decreases a localized charging performance of the charging roller 322*a*. As a result, the charging unit 322C may fail to charge the photoconductive drum 321 to a target potential, creating an abnormal image due to defective charging.

After the electrostatic latent image corresponding to the cyan image is formed on the surface of the photoconductive drum 321C, the developing unit 323C develops the electrostatic latent image with cyan toner into a visible toner image of cyan on the surface of the photoconductive drum 321C.

Referring to FIGS. 4 and 5, the developing unit 323C includes a first developer conveying screw 323*a*, a second developer conveying screw 323*b*, and a developing roller 323*d*. The developing roller 323*d* is disposed opposite the photoconductive drum 321C and generates an electric field inside, thereby serving as a toner bearer that bears toner, which adheres to the photoconductive drum 321C at a later stage in a developing process. At this time, the developing roller 323*d* generates the electric field such that a magnetic force is applied to magnetic flux density in five normal vector directions P1 through P5 indicated by broken lines in FIG. 4.

The first developer conveying screw 323*a* and the second developer conveying screw 323*b* are disposed below the developing roller 323*d*. The first developer conveying screw 323*a* and the second developer conveying screw 323*b* rotate in opposite directions to stir the cyan toner, supplied by a toner supplier from a toner bottle 350C illustrated in FIG. 3, with carrier, and convey the toner such that the toner spreads in an entire scanning direction, which is an axial direction of the first developer conveying screw 323*a* and the second developer conveying screw 323*b*. At this time, the second developer conveying screw 323*b* receives the toner and the carrier conveyed by the first developer conveying screw 323*a* to an end portion of the developing unit 323C. The second developer conveying screw 323*b* conveys the toner and the carrier to the other end portion of the developing unit 323C. The first developer conveying screw 323*a* then receives the toner and the carrier thus conveyed to the other end portion of the developing unit 323C. Thus, the toner and the carrier are conveyed in cycles so as to spread in the entire scanning direction in the developing unit 323C.

The electric field generated inside the developing roller 323*d* draws developer conveyed by the second developer conveying screw 323*b* and causes the developer to adhere to the surface of the developing roller 323*d*. As the developing roller 323*d* rotates, the developer adhering to the surface of the developing roller 323*d* is conveyed to a position where a doctor blade regulates the developer to a predetermined thickness. After being regulated by the doctor blade, the developer is further conveyed to a development zone where the developer faces the photoconductive drum 321C and adheres to the electrostatic latent image formed on the photoconductive drum 321C. Thus, in the present embodiment, the developing roller 323*d* serves as a developer bearer.

A developing bias is generated between the developing roller 323*d* and the photoconductive drum 321C. In the development zone, the developing bias electrostatically moves the toner, which is contained in the developer thus conveyed to the development zone, to the electrostatic latent image corresponding to the cyan image formed on the surface of the photoconductive drum 321C, causing the toner to adhere to the surface of the photoconductive drum 321C. Thus, the developing unit 323C develops the electrostatic latent image with the cyan toner, thereby forming a visible toner image of cyan on the surface of the photoconductive drum 321C. Thus, in the present embodiment, the photoconductive drum 321 serves as a latent image bearer and as an image bearer.

In the present embodiment, a description is given of an example of two-component development. Alternatively, the image forming apparatus 1 may employ single-component development. That is, the developer used in the image forming apparatus 1 is not limited to two-component developer including toner and carrier, but may be single component developer including magnetic toner containing magnetic powder.

Referring back to FIG. 3, a biasing member presses a primary transfer roller 340C against the photoconductive drum 321C at a primary transfer position where the intermediate transfer belt 311 contacts or is in closest approach to the photoconductive drum 321C. As a consequence, the toner image of cyan is transferred from the photoconductive drum 321C onto the intermediate transfer belt 311.

Thus, the toner image of cyan is formed on the intermediate transfer belt 311 as an intermediate transfer image of cyan. At this time, a transfer bias is applied to the primary transfer roller 340C, thereby forming a transfer electric field between the photoconductive drum 321C and the primary transfer roller 340C at the primary transfer position. The transfer electric field transfers the toner image of cyan from the photoconductive drum 321C onto the intermediate transfer belt 311.

After the intermediate transfer image of cyan is formed on the intermediate transfer belt 311, the toner collection unit 325C collects residual toner failed to be transferred onto the intermediate transfer belt 311 and therefore remaining on the surface of the photoconductive drum 321C. Then, the neutralizer 324C neutralizes the surface of the photoconductive drum 321C. The image forming unit 320C then prepares for a next image forming operation. For example, the toner supplier supplies the cyan toner from the toner bottle 350C to the developing unit 323C. Accordingly, the image forming unit 320C is on standby for the next image forming operation. As illustrated in FIG. 3, the toner bottle 350C is disposed in the print engine 300, together with toner bottles 350M, 350Y, and 350K. The toner bottle 350C is removable from the image forming apparatus 1 by opening the printed-sheet ejection tray 400 on an apparatus body of the image forming apparatus 1. It is to be noted that the toner supplier is timed to supply the cyan toner from the toner bottle 350C to the developing unit 323C as needed, not only right after an image forming operation.

Referring to FIGS. 4 and 5, the toner collection unit 325C includes a cleaning blade 325*a*, a collected toner conveying screw 325*b*, and a collected toner conveyance path 325*d*.

The cleaning blade 325*a* has an edge portion made of an elastic material such as urethane rubber. The edge portion of the cleaning blade 325*a* presses against the surface of the photoconductive drum 321C in a direction opposite the rotational direction of the photoconductive drum 321C to scrape the residual toner from the surface of the photoconductive drum 321C. The residual toner thus scraped is collected inside the collected toner conveyance path 325*d*.

The collected toner conveying screw 325*b* conveys the toner thus collected (hereinafter referred to as collected toner) along the collected toner conveyance path 325*d*. The collected toner is conveyed toward a waste toner container that accommodates waste toner, to be discarded as waste toner. Alternatively, the collected toner is conveyed toward the developing unit 323C for reuse.

Referring back to FIG. 3, the toner image of cyan transferred onto the intermediate transfer belt 311 by the image forming unit 320C, that is, the intermediate transfer image of cyan, is conveyed to a primary transfer position between the image forming unit 320M and a primary transfer roller 340M as the intermediate transfer belt 311 is rotated by, e.g., the drive motor, the drive roller 312, and the driven roller 313. In a similar process to the image forming process executed by the image forming unit 320C described above, the image forming unit 320M forms a toner image of magenta on the photoconductive drum 321M, and transfers the toner image of magenta from the photoconductive drum 321M onto the intermediate transfer belt 311. Thus, the toner image of magenta is formed on the intermediate transfer belt 311 as an intermediate transfer image of magenta. Since the toner image of magenta is superimposed on the toner image of cyan while being transferred onto the intermediate transfer belt 311, a composite toner image or intermediate transfer image of cyan and magenta is formed on the intermediate transfer belt 311.

As the intermediate transfer belt 311 rotates, the composite intermediate transfer image of cyan and magenta is conveyed to a primary transfer position between the image forming unit 320Y and a primary transfer roller 340Y where a toner image of yellow formed by the image forming unit 320Y is transferred from the photoconductive drum 321Y onto the intermediate transfer belt 311 as an intermediate transfer image of yellow. Since the toner image of yellow is superimposed on the composite intermediate transfer image of cyan and magenta while being transferred onto the intermediate transfer belt 311, a composite toner image or intermediate transfer image of cyan, magenta, and yellow is formed on the intermediate transfer belt 311. As the intermediate transfer belt 311 rotates, the composite intermediate transfer image of cyan, magenta, and yellow is conveyed to a primary transfer position between the image forming unit 320K and a primary transfer roller 340K where a toner image of black formed by the image forming unit 320K is transferred from the photoconductive drum 321K onto the intermediate transfer belt 311 as an intermediate transfer image of black. Since the toner image of black is superimposed on the composite intermediate transfer image of cyan, magenta, and yellow while being transferred onto the intermediate transfer belt 311, a composite toner image of cyan, magenta, yellow, and black is formed on the intermediate transfer belt 311 as a full-color intermediate transfer image.

Meanwhile, a sheet feeding roller 210 and a separation roller pair 220 feed and separate a plurality of recording media 2 stored in the sheet feeder 200 in order from an uppermost recording medium 2 to convey the recording medium 2 toward a registration roller pair 230. The registration roller pair 230 corrects a skew of the recording medium 2. Then, the registration roller pair 230 is timed to convey the recording medium 2 to a secondary transfer position, where the recording medium 2 contacts or is in closest approach to the intermediate transfer belt 311, through a conveyance passage defined by internal components of the image forming apparatus 1, so that the recording medium 2 meets the full-color intermediate transfer image on the intermediate transfer belt 311.

At the secondary transfer position, a biasing member presses a secondary transfer roller 360 against the driven roller 313, thereby transferring the full-color intermediate transfer image from the intermediate transfer belt 311 onto the recording medium 2. Thus, the toner image is formed on the recording medium 2. The recording medium 2 bearing the toner image is further conveyed to a fixing device 370 that heats and presses the recording medium 2 to fix the toner image onto the recording medium 2. The recording medium 2 bearing the fixed toner image is further conveyed to a sheet ejection roller pair 410 that ejects the recording medium 2 onto the printed-sheet ejection tray 400.

The fixing device 370 includes a fixing roller pair 371. The fixing roller pair 371 rotates to convey the recording medium 2 through the fixing roller pair 371 in a direction perpendicular to a face of the recording medium 2 on which the toner image is formed. While passing through the fixing roller pair 371, the recording medium 2 is pressed by the fixing roller pair 371. In addition, the fixing roller pair 371 has a fixing face on which a heating element is mounted to heat the recording medium 2. Thus, the fixing device 370 fixes the toner image on the recording medium 2 with the fixing roller pair 371 that heats and presses the recording medium 2 passing through the fixing roller pair 371 in the direction perpendicular to the face of the recording medium 2 on which the toner image is formed.

A belt cleaner 380 is disposed downstream from the secondary transfer position and upstream from the image forming unit 320C in the rotational direction of the intermediate transfer belt 311. The belt cleaner 380 scrapes residual toner, failed to be transferred onto the recording medium 2 at the secondary transfer position and therefore remaining on the intermediate transfer bell 311, from the intermediate transfer belt 311 with a cleaning blade. Thus, the belt cleaner 380 cleans the intermediate transfer belt 311.

As described above, in the present embodiment, the print engine 300 includes the conveyor unit 310, the image forming units 320, the optical writing device 330, the primary transfer rollers 340, the toner bottles 350, the secondary transfer roller 360, the fixing device 370, and the belt cleaner 380.

Figure 6:
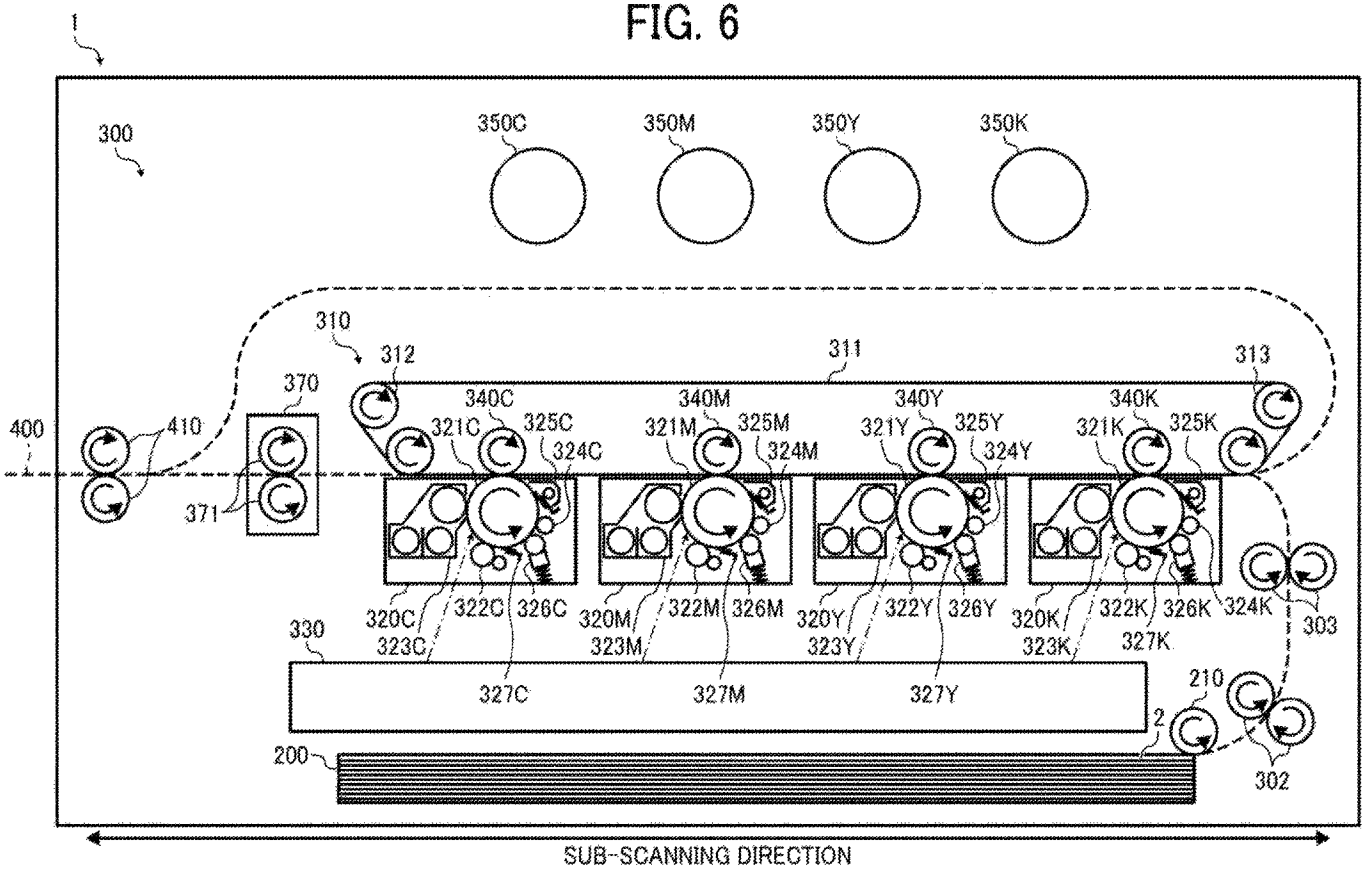
FIG. 6 is a cross-sectional view of an image forming apparatus according to an embodiment of the present disclosure, in which an image is transferred onto a recording medium directly.

It is to be noted that FIG. 3 illustrates the image forming apparatus 1 that employs an indirect transfer method of forming a toner image on an intermediate transfer belt as an intermediate transfer image and transferring the intermediate transfer image onto a recording medium. However, the image forming apparatus 1 may employ a direct transfer method of forming the toner image on the recording medium directly as illustrated in FIG. 6.

As described above with reference to FIGS. 3 through 5, the image forming apparatus 1 charges the surface of the photoconductive drum 321 to form an electrostatic latent image on the photoconductive drum 321, and causes toner as developer to adhere to the electrostatic latent image to develop the electrostatic latent image into a visible toner image. Thus, the image forming apparatus 1 forms the toner image as a developer image on the surface of the photoconductive drum 321. Then, the image forming apparatus 1 transfers the toner image from the surface of the photoconductive drum 321 onto the recording medium 2. The image forming apparatus 1 then heats and presses the recording medium 2 bearing the toner image to fix the toner image onto the recording medium 2.

Also, as described above with reference to FIGS. 3 through 5, the image forming apparatus 1 includes the developing roller 323*d* that rotates while bearing the toner on the surface of the developing roller 323*d* due to electrostatic attraction produced by a magnetic force generated inside the developing roller 323*d*, to convey the toner to a development zone where the developing roller 323*d* faces the photoconductive drum 321 to develop the electrostatic latent image with the toner.

To develop the electrostatic latent image, the image forming apparatus 1 rotates the developing roller 323*d* bearing the toner on the surface of the developing roller 323*d* to convey the toner to the development zone, and applies a developing bias to the developing roller 323*d* in the development zone. When the developing bias exceeds an electrostatic attraction force between the toner and the surface of the developing roller 323*d*, the toner separates from the surface of the developing roller 323*d* and electrostatically moves toward the electrostatic latent image formed on the surface of the rotating photoconductive drum 321. Thus, the image forming apparatus 1 develops the electrostatic latent image.

The image forming apparatus 1 is configured to develop the electrostatic latent image by alternating current (AC) development of superimposing an alternating current (AC) voltage, such as a rectangular wave and a sawtooth wave, on a direct current (DC) voltage, thereby applying the voltages as a developing bias to the developing roller 323*d*.

Figure 7:
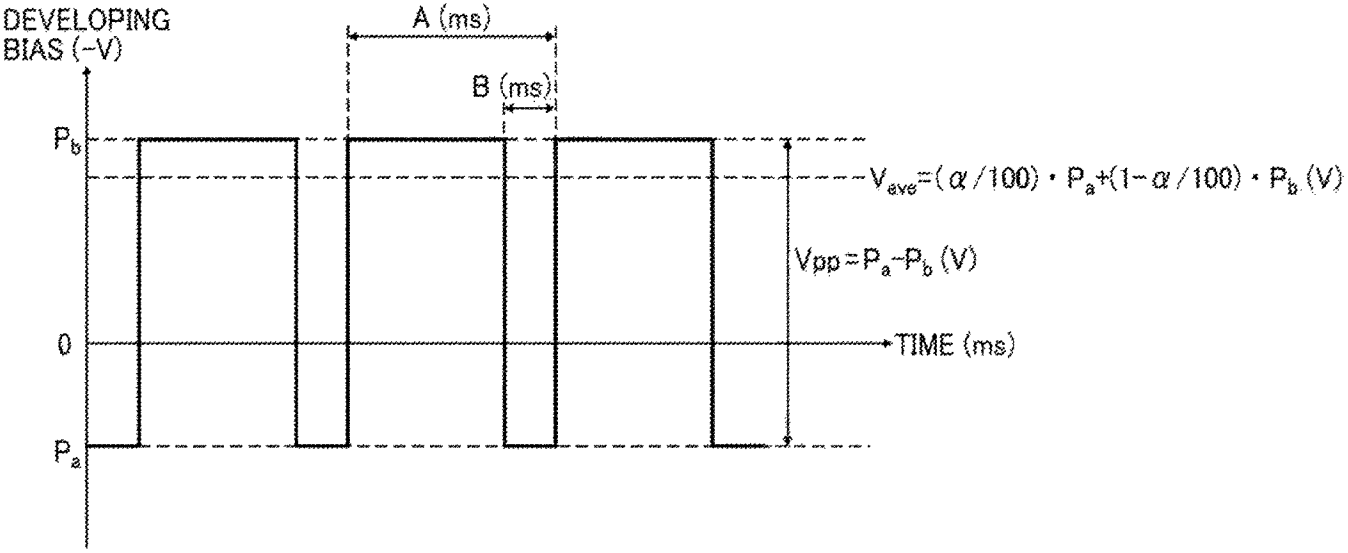
FIG. 7 is a graph illustrating a temporal change in developing bias applied to a developing roller incorporated in the image forming apparatus of FIG. 1.

Referring now to FIG. 7, a description is given of a principle of the AC development by which the image forming apparatus 1 develops the electrostatic latent image.

FIG. 7 is a graph illustrating a temporal change in developing bias applied to the developing roller 323*d*.

The image forming apparatus 1 is configured to apply, as a developing bias, the DC voltage and the AC voltage having a maximum voltage $P_aV$ and a minimum voltage $P_bV$ to the developing roller 323*d*. At this time, an equation of $Vpp=P_a-P_b$ volt (V) is satisfied, where Vpp represents a potential difference between the maximum voltage $P_aV$ and the minimum voltage $P_bV$ of the AC voltage.

In addition, the image forming apparatus 1 is configured to apply, as a developing bias, the AC voltage with a frequency of 1/A kHz such that the maximum voltage $P_aV$ and the minimum voltage $P_bV$ are repeated in A (ms) periods. At this time, a duty or proportion of a time B (ms) for applying the maximum voltage $P_aV$ in one period of the AC voltage is calculated by B/A and indicated as "α" (%) in FIG. 7. Accordingly, in FIG. 7, an average voltage $V_{ave}$ of the AC development equals $(\alpha/100)\cdot P_a+(1-\alpha/100)\cdot P_b$ (V). The average voltage $V_{ave}$ is the DC voltage or DC component of the developing bias applied in the AC development. A developing potential, described below, is an absolute value of a difference (i.e., absolute difference) of the average voltage $V_{ave}$ and an electric potential at an exposed portion of the photoconductive drum 321.

When the electrostatic latent image is developed by the AC development in the image forming apparatus 1, the developing bias of the minimum voltage $P_bV$ moves the toner from the developing roller 323*d* to the photoconductive drum 321. On the other hand, the developing bias of the maximum voltage $P_aV$ pulls back a part of the toner adhering to the photoconductive drum 321 to the developing roller 323*d*.

Thus, in the image forming apparatus 1, the electrostatic latent image is developed when the developing bias is the minimum voltage $P_bV$ whereas a part of the toner adhering to the photoconductive drum 321 is pulled back to the developing roller 323*d* when the developing bias is the maximum voltage $P_aV$. Hereinafter, the minimum voltage $P_bV$ of the developing bias is referred to as bias upon development whereas the maximum voltage $P_aV$ of the developing bias is referred to as pullback bias.

Figure 8:
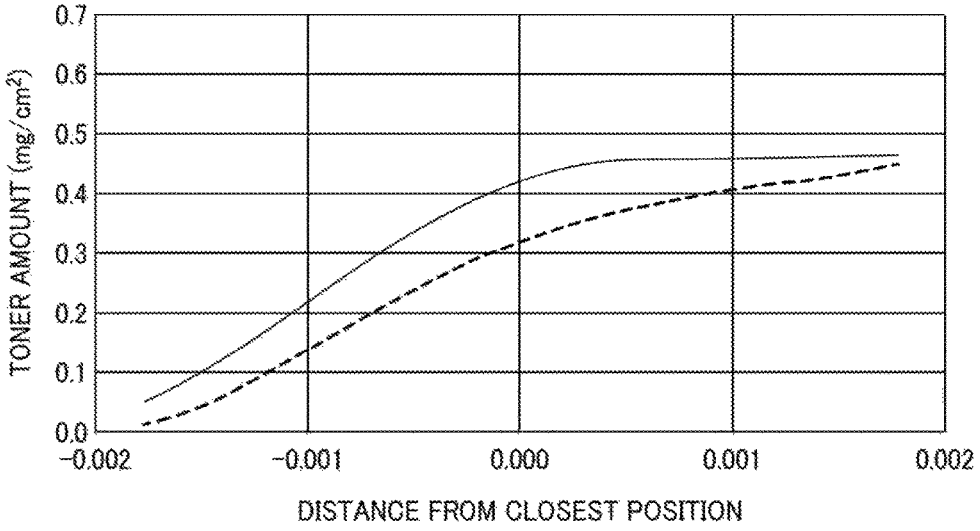
FIG. 8 is a graph illustrating the amount of toner adhering to the surface of a photoconductive drum per unit area in the vicinity of a development zone when a bias upon development is applied to the developing roller and when a pullback bias is applied to the developing roller in the image forming apparatus of FIG. 1.

Referring now to FIG. 8, a description is given of the amount of toner adhering to the surface of the photoconductive drum 321 per unit area in the vicinity of the development zone when the electrostatic latent image is developed as described above.

FIG. 8 is a graph illustrating the amount of toner adhering to the surface of the photoconductive drum 321 per unit area in the vicinity of the development zone when the bias upon development is applied to the developing roller 323*d* and when the pullback bias is applied to the developing roller 323*d* in the image forming apparatus 1.

In FIG. 8, the solid line indicates an amount of toner adhering to the surface of the photoconductive drum 321 per unit area when the bias upon development is applied. The broken line indicates an amount of toner adhering to the surface of the photoconductive drum 321 per unit area when the pullback bias is applied. The horizontal axis of FIG. 8 indicates the distance from a closest position between the surface of the photoconductive drum 321 and the surface of the developing roller 323*d* in the rotational direction of the photoconductive drum 321. Specifically, an upstream side from the closest position in the rotational direction of the photoconductive drum 321, that is, an entry side of the development zone is designated minus (−). A downstream side from the closest position in the rotational direction of the photoconductive drum 321, that is, an exit side of the development zone is designated plus (+). FIG. 8 illustrates the amount of toner ($mg/cm^2$) adhering to the surface of the photoconductive drum 321 per 1 $cm^2$.

As illustrated in FIG. 8, in the image forming apparatus 1, the amount of toner adhering to the surface of the photoconductive drum 321 per unit area tends to increase from the entry side of the development zone toward the exit side of the development zone when the bias upon development is applied and when the pullback bias is applied. This is because the surface of the photoconductive drum 321 is positioned before passing through the development zone on the entry side of the development zone whereas the surface of the photoconductive drum 321 is positioned after passing through the development zone on the exit side of the development zone.

In addition, when the pullback bias is applied to the developing roller 323*d*, the amount of toner adhering to the surface of the photoconductive drum 321 per unit area is smaller than the amount of toner adhering to the surface of the photoconductive drum 321 per unit area when the bias upon development is applied to the developing roller 323*d*. This is because a part of the toner adhering to the photoconductive drum 321 is pulled back to the developing roller 323*d* when the pullback bias is applied to the developing roller 323*d*.

As the developing roller and the photoconductive drum rotate, the eccentricity of a developing roller and a photoconductive drum may periodically change the size of a developing gap, which is a distance between the surface of the developing roller and the surface of the photoconductive drum in the development zone. Such a change in developing gap also changes an electric field generated by a developing bias applied to the developing roller. Specifically, a smaller developing gap strengthen the electric field whereas a larger developing gap weakens the electric field.

Therefore, in an image forming apparatus in which a developing gap changes, a smaller developing gap increases an amount of toner moving to an electrostatic latent image and therefore increases a localized image density of a toner image into which the electrostatic latent image is developed. By contrast, a larger developing gap decreases the amount of toner moving to the electrostatic latent image and therefore decreases the localized image density of the toner image. As a result, such a change in developing gap causes periodic unevenness in image density.

Figure 9:
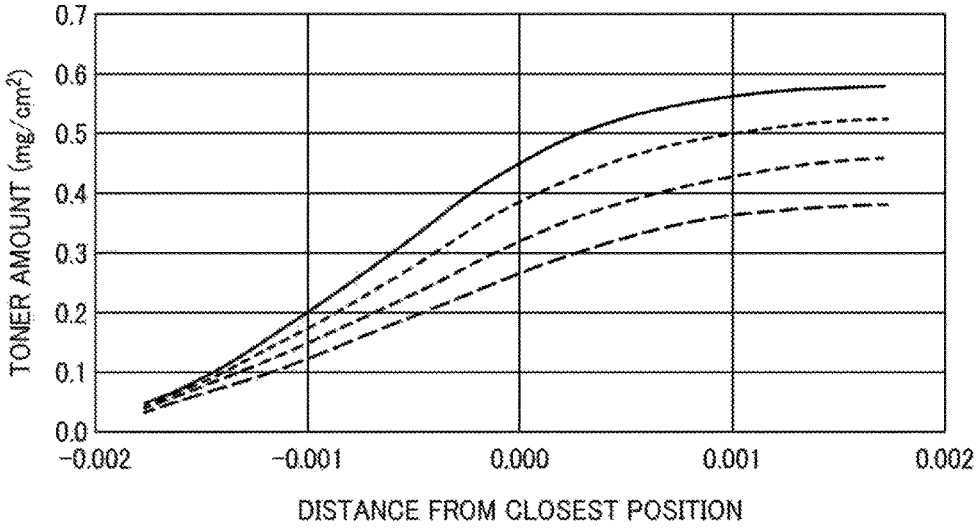
FIG. 9 is a graph illustrating the amount of toner adhering to the surface of a photoconductive drum per unit area in the vicinity of a development zone when a direct current voltage as a developing bias is applied to a developing roller in an image forming apparatus that employs a direct current development to develop an electrostatic latent image.
Figure 10:
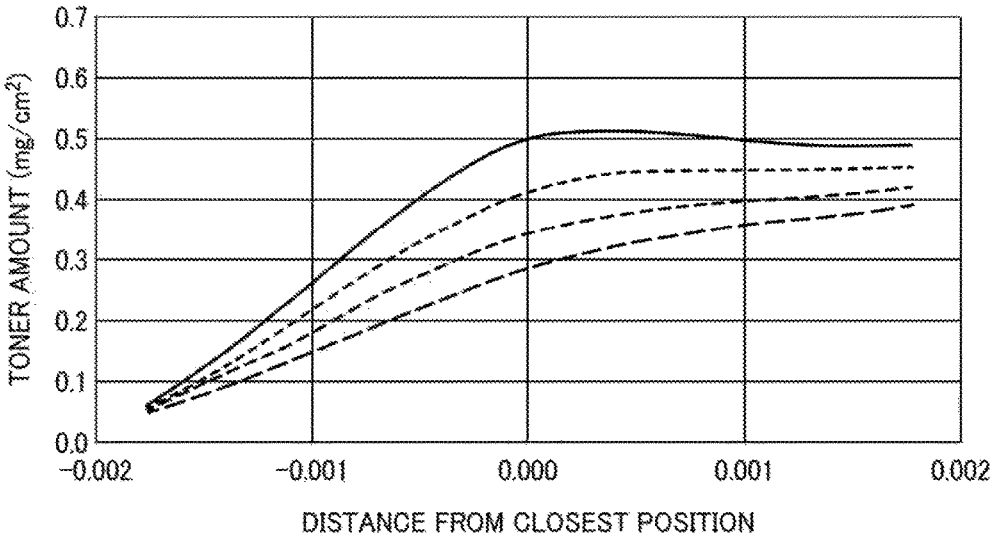
FIG. 10 is a graph illustrating the amount of toner adhering to the surface of a photoconductive drum per unit area in the vicinity of a development zone when the bias upon development as a developing bias is applied to a developing roller in an image forming apparatus that employs an alternating current development to develop an electrostatic latent image.
Figure 11:
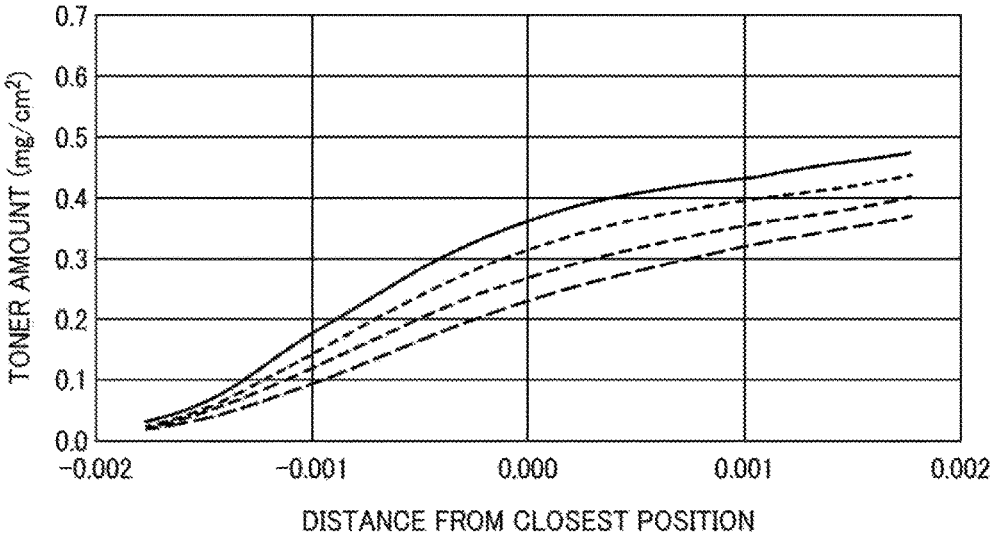
FIG. 11 is a graph illustrating the amount of toner adhering to the surface of the photoconductive drum per unit area in the vicinity of the development zone when the pullback bias as a developing bias is applied to the developing roller in the image forming apparatus that employs the alternating current development to develop an electrostatic latent image.

Such periodic unevenness in image density due to changes in size of the developing gap is particularly noticeable in direct current (DC) development, in which an electrostatic latent image is developed by applying only the DC voltage as a developing bias to a developing roller, compared to the AC development, as illustrated in FIGS. 9 through 11.

FIG. 9 is a graph illustrating the amount of toner adhering to the surface of a photoconductive drum per unit area in the vicinity of a development zone when the DC voltage as a developing bias is applied to a developing roller in an image forming apparatus that employs the DC development to develop an electrostatic latent image. FIG. 10 is a graph illustrating the amount of toner adhering to the surface of a photoconductive drum per unit area in the vicinity of a development zone when the bias upon development as a developing bias is applied to a developing roller in an image forming apparatus that employs the AC development to develop an electrostatic latent image. FIG. 11 is a graph illustrating the amount of toner adhering to the surface of the photoconductive drum per unit area in the vicinity of the development zone when the pullback bias as a developing bias is applied to the developing roller in the image forming apparatus that employs the AC development to develop an electrostatic latent image.

It is to be noted that FIGS. 10 and 11 illustrate cases when a high-frequency AC voltage is applied as a developing bias.

In each of FIGS. 9 through 11, the solid line indicates the amount of toner when the developing gap is 0.2 mm. The dotted line indicates the amount of toner when the developing gap is 0.225 mm. The broken line indicates the amount of toner when the developing gap is 0.26 mm. The long broken line indicates the amount of toner when the developing gap is 0.3 mm. In addition, the horizontal axis indicates the distance from the closest position between the surface of the photoconductive drum and the surface of the developing roller in a rotational direction of the photoconductive drum. Specifically, the upstream side from the closest position in the rotational direction of the photoconductive drum, that is, the entry side of the development zone is designated minus (−). The downstream side from the closest position in the rotational direction of the photoconductive drum, that is, the exit side of the development zone is designated plus (+). FIGS. 9 through 11 illustrates the amount of toner (mg/cm$^2$) adhering to the surface of the photoconductive drum per 1 cm$^2$.

As is clear from comparison of FIGS. 9 and 10, and of FIGS. 9 and 11, when the electrostatic latent image is developed by the DC development, the change in amount of toner adhering to the surface of the photoconductive drum per unit area in the vicinity of an exit of the development zone due to changes in size of the developing gap is larger than the change in amount of toner adhering to the surface of the photoconductive drum per unit area in the vicinity of the exit of the development zone due to changes in size of the developing gap when the electrostatic latent image is developed by the AC development. That is, in the image forming apparatus that employs the AC development, the change in amount of toner adhering to the surface of the photoconductive drum per unit area in the vicinity of the exit of the development zone due to changes in size of the developing gap is smaller than the change in amount of toner adhering to the surface of the photoconductive drum per unit area in the vicinity of the exit of the development zone due to changes in size of the developing gap in the image forming image forming apparatus that employs the DC development.

Such periodic unevenness in image density due to changes in size of the developing gap appears in the AC development as illustrated in FIGS. 10 and 11. However, as illustrated in FIG. 9 and mentioned previously, the periodic unevenness in image density due to changes in size of the developing gap is more noticeable in the DC development than in the AC development. For example, in comparison of the DC development (FIG. 9) to the AC development (FIGS. 10 and 11) when the distance from the closest position between the surface of the photoconductive drum and the surface of the developing roller in the rotational direction of the photoconductive drum is from about 0.001 to about 0.002, the change in amount of toner due to changes in size of the developing gap is larger in the DC development (FIG. 9) than in the AC development (FIGS. 10 and 11). Therefore, the image forming apparatus 1 employs the AC development to develop the electrostatic latent image.

In the AC development, however, the periodic unevenness in image density due to changes in size of the developing gap occurs only when a high-frequency AC voltage exceeding a predetermined frequency is applied to the developing roller as a developing bias. Hence, the image forming apparatus 1 applies a low-frequency AC voltage less than the predetermined frequency to the developing roller 323*d* as a developing bias, to prevent such periodic unevenness in image density.

A description is now given of why the periodic unevenness in image density due to changes in size of the developing gap occurs only when a high-frequency AC voltage is applied to the developing roller.

Firstly, a description is given of a relationship between the developing gap and the amount of toner adhering to the photoconductive drum 321. A smaller developing gap strengthen the electric field generated by the developing bias applied to the developing roller 323*d* whereas a larger developing gap weakens the electric field.

Accordingly, a smaller developing gap increases a development amount, which is an amount of toner moving from the developing roller 323*d* to the photoconductive drum 321, while the bias upon development is applied to the developing roller 323*d*. The smaller developing gap also increases a pullback amount, which is an amount of toner pulled back from the photoconductive drum 321, while the pullback bias is applied to the developing roller 323*d*. Therefore, even when the developing gap is relatively small, an excessive amount of toner does not adhere to the photoconductive drum 321. In other words, an appropriate amount of toner adheres to the photoconductive drum 321.

By contrast, a larger developing gap decreases the development amount while the bias upon development is applied to the developing roller 323*d*. The larger developing gap also decreases the pullback amount while the pullback bias is applied to the developing roller 323*d*. Therefore, even when the developing gap is relatively large, the amount of toner adhering to the photoconductive drum 321 is not less than a desired amount of toner. In other words, an appropriate amount of toner adheres to the photoconductive drum 321.

Thus, when the development amount and the pullback amount are balanced, an appropriate amount of toner adheres to the photoconductive drum 321 regardless of the changes in size of the developing gap.

However, if a high-frequency AC voltage is applied to the developing roller 323*d* as a developing bias, the pullback bias applied to the developing roller 323*d* may fail to pull back the toner from the photoconductive drum 321 at the closest position between the photoconductive drum 321 and the developing roller 323*d* in the development zone, resulting in hopping of the toner along the surface of the photoconductive drum 321 and disrupting the balance between the development amount and the pullback amount. In short, applying a high-frequency AC voltage to the developing roller 323*d* may cause an imbalance between the development amount and the pullback amount, resulting in the periodic unevenness in image density due to changes in size of the developing gap.

Hence, as described with reference to FIGS. 7 and 8, the image forming apparatus 1 is configured to apply, as a developing bias, a low-frequency AC voltage to the developing roller 323*d*. As a low-frequency AC voltage having a frequency less than a threshold may cause the unevenness in image density visible in a switching period between the bias upon development and the pullback bias, the AC voltage applied to the developing roller 323*d* has a frequency not less than the threshold.

A description is now given of why such a low-frequency AC voltage less than the threshold causes the unevenness in image density visible in the switching period between the bias upon development and the pullback bias.

A range of unevenness in image density is defined by how long the photoconductive drum 321 continues to rotate in the interval between the bias upon development and the pullback bias. The range of unevenness in image density can be calculated by the following equation:

the range (mm) of unevenness in image density=the rotational linear velocity (mm/s) of the photoconductive drum 321/the frequency (Hz) of the developing bias.

The range (mm) of unevenness in image density thus defined is decreased and may become invisible as the frequency of the AC voltage applied as a developing bias increases. On the other hand, the range (mm) of unevenness in image density is increased and may become visible as the frequency of the AC voltage applied as a developing bias decreases.

Therefore, the image forming apparatus 1 is configured to apply, as a developing bias, a low-frequency AC voltage not less than the threshold to the developing roller 323*d*. As described above, the range (mm) of unevenness in image density depends on the rotational linear velocity of the photoconductive drum 321. Therefore, in the image forming apparatus 1, the frequency of the AC voltage applied to the developing roller 323*d* as a developing bias changes depending on the rotational linear velocity of the photoconductive drum 321.

Thus, the image forming apparatus 1 is configured to apply, as a developing bias, a low-frequency AC voltage not less than the threshold to the developing roller 323*d* in the AC development so as to prevent the periodic unevenness in image density due to changes in size of the developing gap.

However, in a case where a low-frequency AC voltage as a developing bias is applied to the developing roller 323*d*, inappropriate duty and potential difference Vpp of the developing bias may cause image failure when the pullback bias is applied to the developing roller 323*d* to pull back the toner from the photoconductive drum 321. That is, in an image forming apparatus that applies a low-frequency AC voltage as a developing bias to a developing roller, the duty and the potential difference Vpp of the developing bias are precisely regulated.

Specifically, in such an image forming apparatus, the pullback bias and the duty of the developing bias are decreased to prevent image failure. Since the charged amount of toner changes the pullback bias and the duty of the developing bias, the pullback bias and the duty of the developing bias are decreased in comparison at the same charged amount of toner.

With such a decrease in the pullback bias and the duty of the developing bias, the toner is pulled back from the photoconductive drum 321 mainly at the closest position between the photoconductive drum 321 and the developing roller 323*d* in the development zone. Consequently, image failure is prevented. The duty of the developing bias exceeds a threshold preferably at the closest position between the photoconductive drum 321 and the developing roller 323*d* to pull back the toner from the photoconductive drum 321.

Therefore, the duty and the potential difference Vpp of the developing bias are precisely regulated in the image forming apparatus that applies a low-frequency AC voltage as a developing bias to the developing roller. As described above, the appropriate duty and potential difference Vpp that has an impact on the pullback bias depend on the charged amount of toner within the developing unit 323.

Accordingly, the image forming apparatus 1 is configured to determine the duty and the potential difference Vpp based on the charged amount of toner within the developing unit 323 so as to prevent image failure.

Thus, the image forming apparatus 1 is configured to apply, as the developing bias, a low-frequency AC voltage to the developing roller 323*d* in the AC development, and to determine the duty and the potential difference Vpp based on the charged amount of toner within the developing unit 323. Accordingly, the image forming apparatus 1 prevents the periodic unevenness in image density due to changes in the size of the developing gap, and further prevents image failure. Thus, the image forming apparatus 1 enhances image quality.

Figure 12:
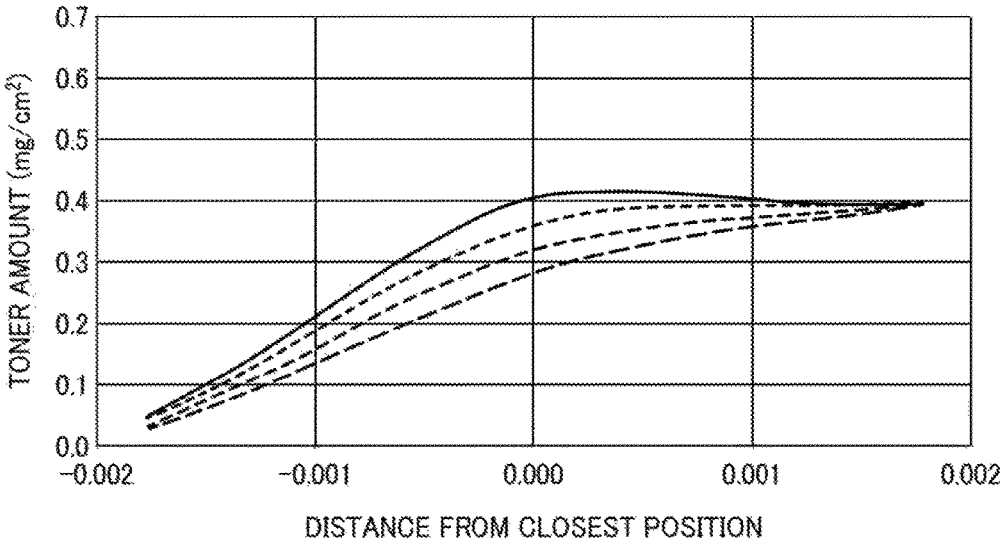
FIG. 12 is a graph illustrating the amount of toner adhering to the surface of the photoconductive drum per unit area in the vicinity of the development zone when the bias upon development is applied to the developing roller in the image forming apparatus of FIG. 1.
Figure 13:
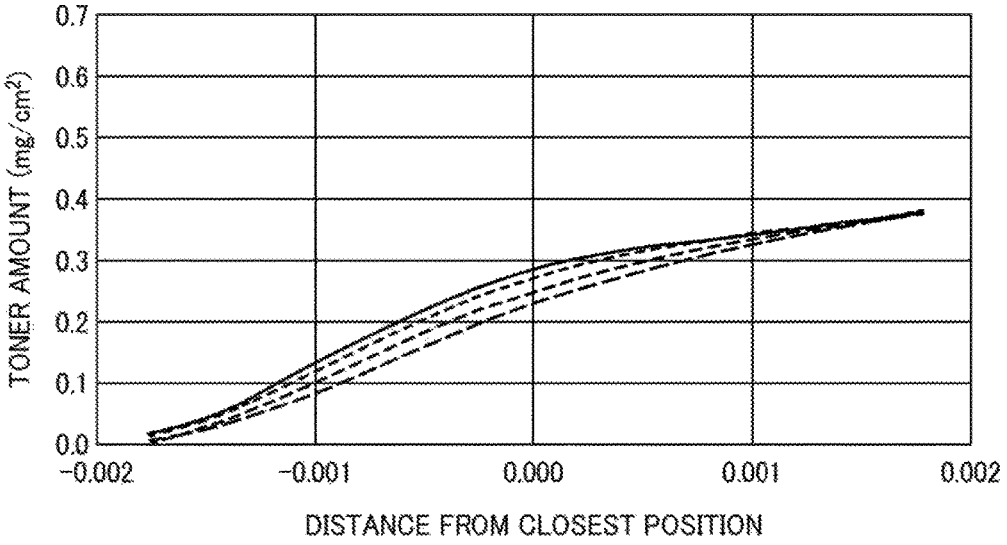
FIG. 13 is a graph illustrating the amount of toner adhering to the surface of the photoconductive drum per unit area in the vicinity of the development zone when the pullback bias is applied to the developing roller in the image forming apparatus of FIG. 1.

Referring now to FIGS. 12 and 13, a description is given of the amount of toner adhering to the surface of the photoconductive drum 321 per unit area in the vicinity of the development zone when a low-frequency AC voltage is applied to the developing roller 323*d*.

FIG. 12 is a graph illustrating the amount of toner adhering to the surface of the photoconductive drum 321 per unit area in the vicinity of the development zone when the bias upon development is applied to the developing roller 323*d* in the image forming apparatus 1. FIG. 13 is a graph illustrating the amount of toner adhering to the surface of the photoconductive drum 321 per unit area in the vicinity of the development zone when the pullback bias is applied to the developing roller 323*d* in the image forming apparatus 1.

It is to be noted that FIGS. 10 and 11 illustrate the cases when a high-frequency AC voltage is applied as a developing bias whereas FIGS. 12 and 13 illustrate cases when a low-frequency AC voltage is applied as a developing bias.

In each of FIGS. 12 through 13, the solid line indicates the amount of toner when the developing gap is 0.2 mm. The dotted line indicates the amount of toner when the developing gap is 0.225 mm. The broken line indicates the amount of toner when the developing gap is 0.26 mm. The long broken line indicates the amount of toner when the developing gap is 0.3 mm. In addition, the horizontal axis indicates the distance from the closest position between the surface of the photoconductive drum 321 and the surface of the developing roller 323*d* in the rotational direction of the photoconductive drum 321. Specifically, the upstream side from the closest position in the rotational direction of the photoconductive drum 321, that is, the entry side of the development zone is designated minus (−). The downstream side from the closest position in the rotational direction of the photoconductive drum 321, that is, the exit side of the development zone is designated plus (+). FIGS. 12 through 13 illustrates the amount of toner ($mg/cm^2$) adhering to the surface of the photoconductive drum 321 per 1 $cm^2$.

As is clear from comparison of FIGS. 10 and 12 and of FIGS. 11 and 13, the image forming apparatus 1 that applies a low-frequency AC voltage as a developing bias to the developing roller 323*d* in the AC development enhances prevention of the periodic unevenness in image density due to changes in size of the developing gap, compared to the image forming apparatus that applies a high-frequency AC voltage as a developing bias to the developing roller.

Figure 14:
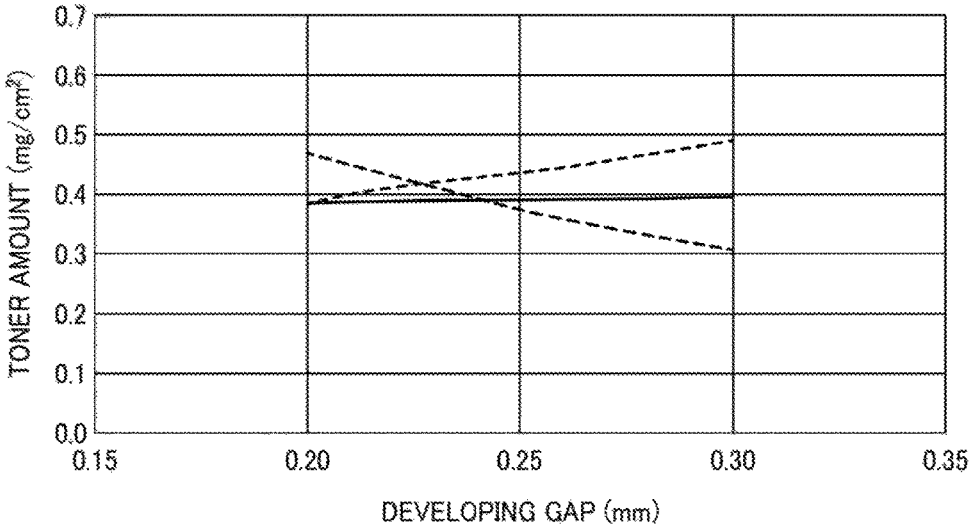
FIG. 14 is a graph illustrating changes in amount of toner adhering to the surface of the photoconductive drum per unit area due to change in developing gap when the developing bias is applied to the developing roller to develop an electrostatic latent image in various development ways.

Consequently, as illustrated in FIG. 14, the image forming apparatus 1 that applies a low-frequency AC voltage as a developing bias in the AC development enhances prevention of the periodic unevenness in image density due to changes in size of the developing gap, compared to the image forming apparatuses that perform the DC development or the AC development by applying a high-frequency AC voltage as a developing bias to the developing roller.

FIG. 14 is a graph illustrating changes in amount of toner adhering to the surface of the photoconductive drum per unit area due to changes in size of the developing gap when the developing bias is applied to the developing roller to develop an electrostatic latent image in various development ways.

In FIG. 14, the vertical axis indicates the amount of toner ($mg/cm^2$) adhering to the surface of the photoconductive drum per 1 $cm^2$ whereas the horizontal axis indicates the developing gap (mm).

The solid line indicates a case where an electrostatic latent image is developed by applying a low-frequency AC voltage in the AC development in the image forming apparatus 1. The dotted line indicates a case where an electrostatic latent image is developed by applying a high-frequency AC voltage as a developing bias in the AC development. The broken line indicates a case where an electrostatic latent image is developed by the DC development.

Figure 15B:
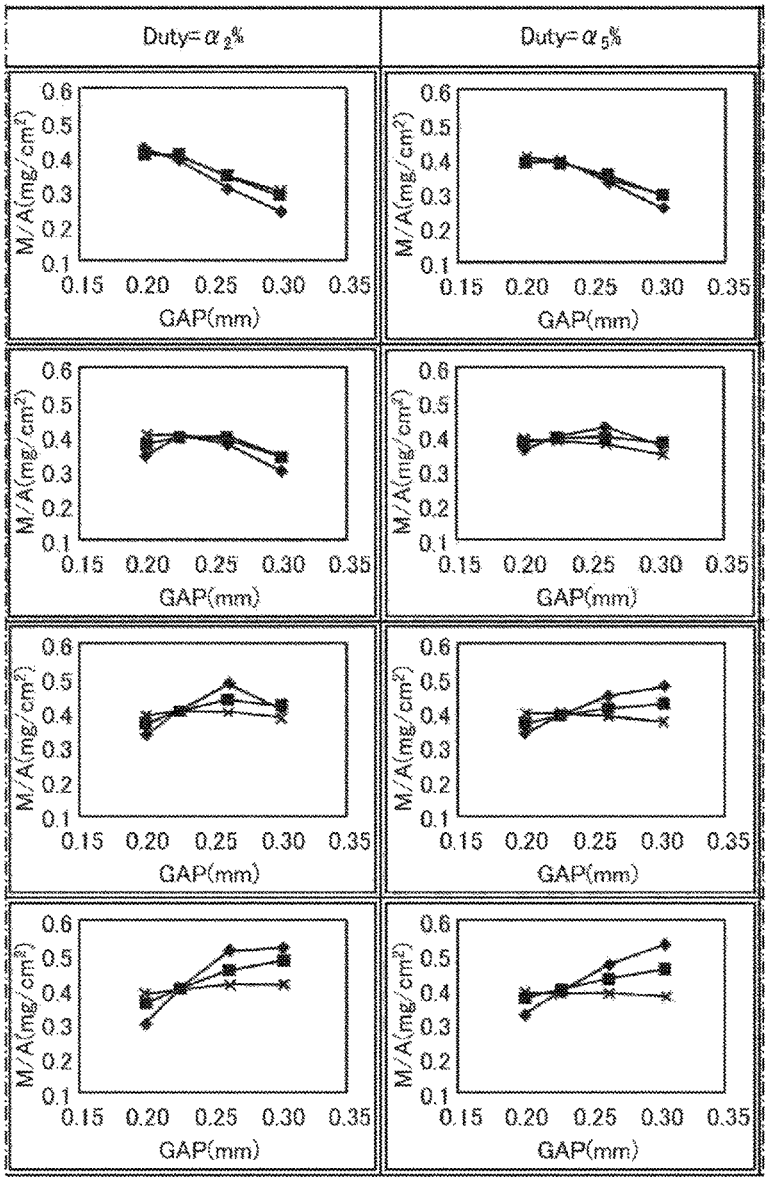
Figure 15C:
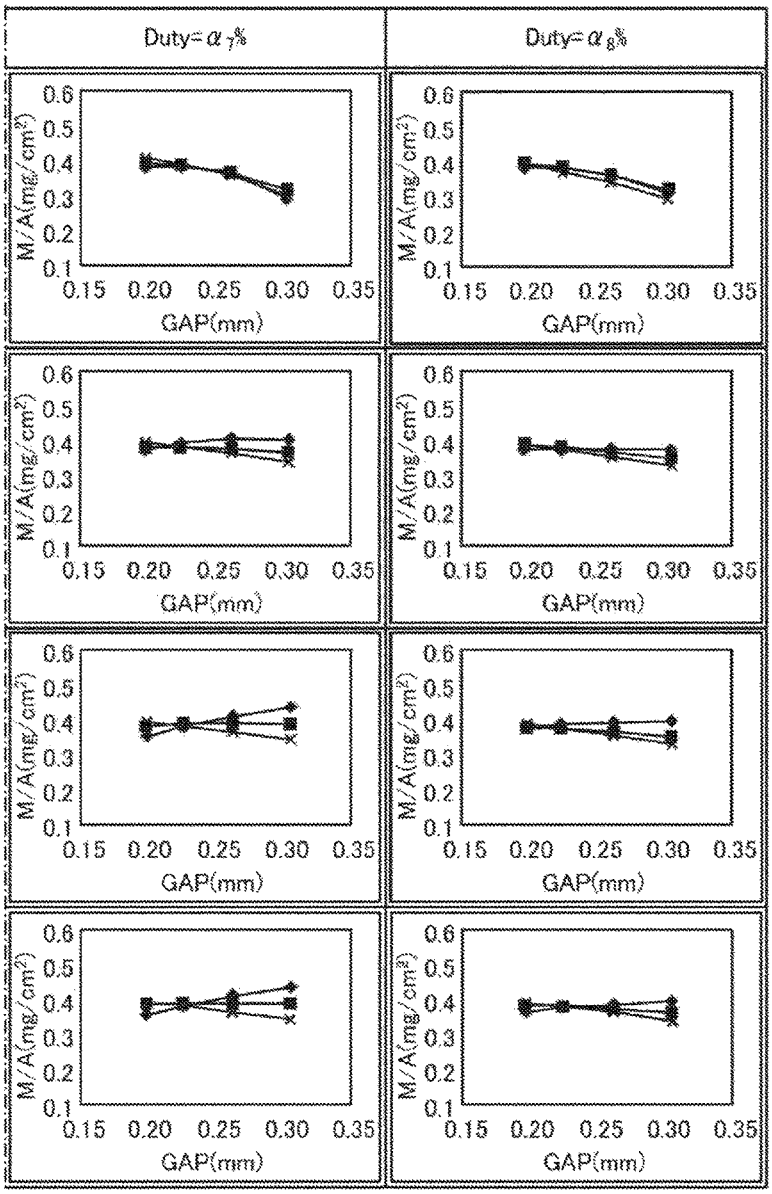

Referring now to FIGS. 15A-15C, a description is given of determination of the duty and the potential difference Vpp based on the charged amount of toner in the image forming apparatus 1.

FIGS. 15A-15C are graphs illustrating changes in amount of toner adhering to the surface of the photoconductive drum 321 per unit area for each combination or sub-graph of the duty and the potential difference Vpp when the bias upon development is applied to the developing roller 323*d* to develop an electrostatic latent image in the image forming apparatus 1.

FIGS. 15A-15C illustrate a case where the toner density within the developing unit 323 is $S_3$ (wt %). For each sub-graph of FIGS. 15A-15C, the line connecting diamond marks indicates a case where the charged amount of toner is $E_2$ μC/g. The line connecting square marks indicates a case where the charged amount of toner is $E_4$ μC/g. The line connecting x-marks indicates a case where the charged amount of toner is $E_8$ μC/g. "M/A ($mg/cm^2$)" designates the amount of toner adhering to the surface of the photoconductive drum 321 per unit area whereas "GAP (mm)" designates the developing gap. In FIGS. 15A-15C, the charged amount of toner satisfies a relation of $E_2<E_4<E_8$. The duty satisfies a relation of $\alpha_1<\alpha_2<\alpha_5<\alpha_7<\alpha_8$. The potential difference Vpp satisfies a relation of $P_1<P_3<P_5<P_6$.

As illustrated in FIGS. 15A-15C, the changes in amount of toner adhering to the surface of the photoconductive drum 321 per unit area due to changes in size of the developing gap depend on the charged amount of toner within the developing unit 323, and further depend on the combination of the duty and the potential difference Vpp.

Accordingly, the image forming apparatus 1 is configured to select a combination of duty and potential difference Vpp that minimizes the change in amount of toner adhering to the surface of the photoconductive drum 321 per unit area due to changes in size of the developing gap, depending on the charged amount of toner. Thus, the image forming apparatus 1 is configured to determine the duty and the potential difference Vpp based on the charged amount of toner within the developing unit 323.

For example, in FIGS. 15A-15C, for the charged amount of toner of $E_2$ μC/g, a combination of Duty=$\alpha_7$% and Vpp=$P_3$V indicates a minimum change in amount of toner adhering to the surface of the photoconductive drum 321 per unit area due to changes in size of the developing gap. For the charged amount of toner of $E_4$ μCg, a combination of Duty=$\alpha_5$% and Vpp=$P_3$V indicates a minimum change in amount of toner adhering to the surface of the photoconductive drum 321 per unit area due to changes in size of the developing gap. For the charged amount of toner of $E_8$ μC/g, a combination of Duty=$\alpha_2$% and Vpp=$P_3$V indicates a minimum change in amount of toner adhering to the surface of the photoconductive drum 321 per unit area due to changes in size of the developing gap.

Accordingly, when the toner density is $S_3$ (wt %), the image forming apparatus 1 determines the duty and the potential difference Vpp as Duty=$\alpha_7$% and Vpp=$P_3$V for the charged amount of toner of $E_2$ μC/g, as Duty=$\alpha_5$% and Vpp=$P_3$V for the charged amount of toner of $E_4$ μC/g, and as Duty=$\alpha_2$% and Vpp=$P_3$V for the charged amount of toner of $E_8$ μC/g.

In FIGS. 5A-15C, for the charged amount of toner of $E_8$ μC/g, for example, a combination of Duty=$\alpha_5$% and Vpp=$P_6$V indicates a smaller change in amount of toner adhering to the surface of the photoconductive drum 321 per unit area due to changes in size of the developing gap than the change indicated by the combination of Duty=$\alpha_2$% and Vpp=$P_3$V thus determined. However, the image forming apparatus 1 does not determine the duty and the potential difference Vpp as Duty=$\alpha_5$% and Vpp=$P_6$V when the charged amount of toner is $E_8$ μC/g.

As described above, an image forming apparatus that applies a low-frequency AC voltage as a developing bias to the developing roller reduces the pullback bias and the duty of the developing bias to prevent image failure. When the potential difference Vpp equals $P_5$V (i.e., Vpp=$P_5$V, which is relatively large, the pullback bias is too large to prevent image failure.

In FIGS. 15A-15C, for the charged amount of toner of $E_2$ μC/g, for example, a combination of Duty=$\alpha_8$% and Vpp=$P_3$V indicates a smaller change in amount of toner adhering to the surface of the photoconductive drum 321 per unit area due to changes in size of the developing gap than the change indicated by the combination of Duty=$\alpha_4$% and Vpp=$P_3$V thus determined. However, the image forming apparatus 1 does not determine the duty and the potential difference Vpp as Duty=$\alpha_8$% and Vpp=$P_3$V when the charged amount of toner is $E_2$ μC/g.

As described above, an image forming apparatus that applies a low-frequency AC voltage as a developing bias to a developing roller reduces the pullback bias and the duty of the developing bias to prevent image failure. When the duty equals $\alpha_8$% (i.e., Duty=$\alpha_8$%), which is relatively large, the duty is too large to prevent image failure.

Thus, the image forming apparatus 1 is configured to determine appropriate duty and potential difference Vpp based on the charged amount of toner within the developing unit 323. Even when the charged amount of toner is stable within the developing unit 323, the appropriate duty and potential difference Vpp may vary depending on the toner density within the developing unit 323.

Accordingly, the image forming apparatus 1 is configured to determine the duty and the potential difference Vpp based on the toner density within the developing unit 323 in addition to the charged amount of toner within the developing unit 323.

Specifically, the image forming apparatus 1 is configured to determine the duty and the potential difference Vpp, after measuring the toner density and the charged amount of toner within the developing unit 323, by referring to a duty-Vpp determination table that matches the duty and the potential difference Vpp for each combination of the toner density and the charged amount of toner within the developing unit 323, as illustrated in FIG. 16.

FIG. 16 is a graph illustrating an example of the duty-Vpp determination table according to an embodiment of the present disclosure.

Such a table is stored in a storage medium such as the ROM 30 and HDD 40 illustrated in FIG. 1.

Accordingly, the image forming apparatus 1 determines the duty and the potential difference Vpp by referring to the duty-Vpp determination table as illustrated in 16, based on the toner density and the charged amount of toner within the developing unit 323. Storing the duty-Vpp determination table as illustrated in FIG. 16 in a nonvolatile storage medium such as the ROM 30 and the HDD 40 allows the image forming apparatus 1 to refer to the duty-Vpp determination table any time. In FIG. 16, the toner density satisfies a relation of $S_1<S_2<S_3<S_4<S_5$. The charged amount of toner satisfies a relation of $E_1<E_2<E_3<E_4<E_5<E_6<E_7<E_8$. The duty satisfies a relation of $\alpha_1<\alpha_2<\alpha_3<\alpha_4<\alpha_5<\alpha_6<\alpha_7<\alpha_8$. The potential difference Vpp satisfies a relation of $P_1<P_2<P_3<P_4<P_5<P_6<P_7$.

Since the image forming apparatus 1 includes a toner density detection sensor that detects the toner density within the developing unit 323, the image forming apparatus 1 is able to directly measure the toner density (wt %) within the developing unit 323. On the other hand, the image forming apparatus 1 is not able to directly measure the charged amount of toner within the developing unit 323. Therefore, the image forming apparatus 1 is configured to predict the charged amount of toner within the developing unit 323 based on a developing gamma (γ) and the toner density within the developing unit 323.

To predict the charged amount of toner within the developing unit 323, first, the image forming apparatus 1 measures the developing gamma ($mg/cm^2 \cdot V$). The developing gamma (mg/cm2·V) is a changed amount of toner adhering to the surface of the photoconductive drum 321 per unit area due to changes in developing potential. The developing gamma (mg/cm2·V) is an index that indicates the ease with which the toner adheres to the photoconductive drum 321. It is to be noted that the developing potential is an absolute difference of an electric potential of the DC component of the developing bias applied to the developing roller 323*d* and the electric potential at the exposed portion of the photoconductive drum 321.

To measure the developing gamma, the image forming apparatus 1 changes the developing potential and measures the amount of toner adhering to the surface of the photoconductive drum 321 per unit area for each developing potential. The image forming apparatus 1 includes a sensor for detecting the amount of toner adhering to the surface of the photoconductive drum 321, to measure the amount of toner adhering to the surface of the photoconductive drum 321 per unit area for each developing potential.

Figure 17:
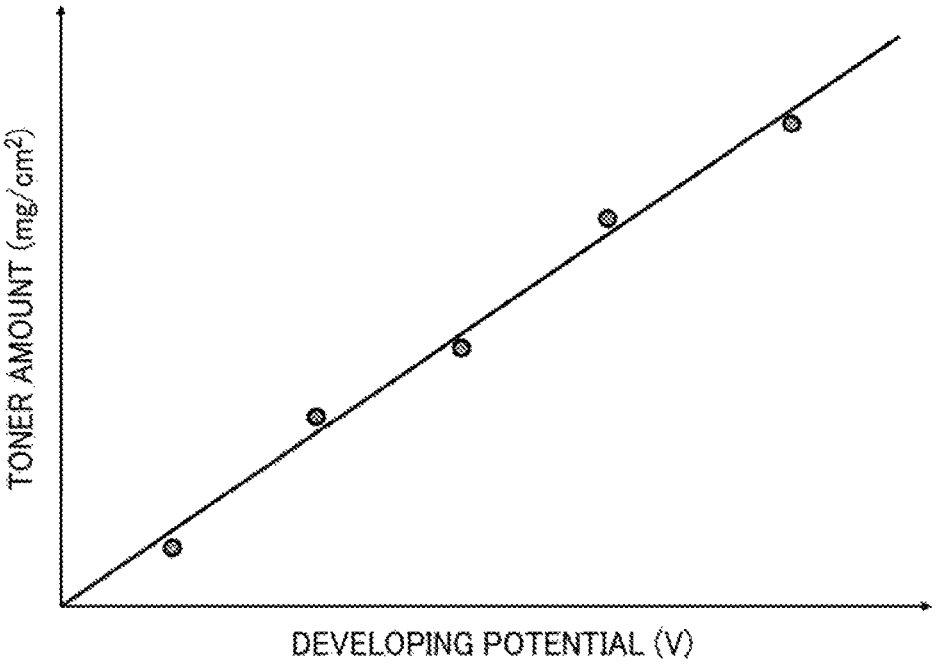
FIG. 17 is a graph illustrating the change in amount of toner adhering to the surface of the photoconductive drum per unit area due to change in developing potential.

The image forming apparatus 1 plots the amount of toner adhering to the surface of the photoconductive drum 321 per unit area thus measured for each developing potential on a graph as illustrated in FIG. 17, in which the horizontal axis indicates the developing potential whereas the vertical axis indicates the amount of toner adhering to the surface of the photoconductive drum 321 per unit area.

FIG. 17 is a graph illustrating the change in amount of toner adhering to the surface of the photoconductive drum 321 per unit area due to changes in developing potential.

The image forming apparatus 1 calculates a gradient of an approximation straight line based on the points thus plotted by a least-squares approach. The gradient thus calculated is defined as a developing gamma (γ). The image forming apparatus 1 performs such processing with, e.g., the CPU 10 and the RAM 20 illustrated in FIG. 1, and stores the developing gamma in the HDD 40 illustrated in FIG. 1.

In the present embodiment, the developing gamma is defined as a changed amount of toner adhering to the surface of the photoconductive drum 321 per unit area due to changes in developing potential. Alternatively, the developing gamma may be defined as a changed amount of toner contained in the intermediate transfer image formed on the intermediate transfer belt 311 per unit area due to changes in developing potential. In such a case, to measure the developing gamma, the image forming apparatus 1 changes the developing potential and measures the amount of toner contained in the intermediate transfer image per unit area for each developing potential. The image forming apparatus 1 includes a sensor for detecting the amount of toner contained in the intermediate transfer image formed on the intermediate transfer belt 311, to measure the amount of toner contained in the intermediate transfer image per unit area for each developing potential.

The image forming apparatus 1 plots the amount of toner contained in the intermediate transfer image per unit area thus measured for each developing potential on a graph, in which the horizontal axis indicates the developing potential whereas the vertical axis indicates the amount of toner contained in the intermediate transfer image per unit area. The image forming apparatus 1 calculates a gradient of an approximation straight line based on the points thus plotted by a least-squares approach. The gradient thus calculated is defined as a developing gamma (γ). The image forming apparatus 1 performs such processing with, e.g., the CPU 10 and the RAM 20 illustrated in FIG. 1, and stores the developing gamma in the HDD 40 illustrated in FIG. 1.

After measuring the developing gamma as described above, the image forming apparatus 1 determines the charged amount of toner within the developing unit 323 based on the toner density and the developing gamma thus measured, by referring to a charged-toner-amount determination table that illustrates the charged amount of toner for each combination of the developing gamma and the toner density as illustrated in FIG. 18.

FIG. 18 is an example of the charged-toner-amount determination table according to an embodiment of the present disclosure.

In FIG. 18, the developing gamma satisfies a relation of $\gamma_1>\gamma_2>\gamma_3>\gamma_4>\gamma_5$. Such a table is stored in a storage medium such as the ROM 30 and HDD 40 illustrated in FIG. 1.

After determining the charged amount of toner, the image forming apparatus 1 determines the duty and the potential difference Vpp based on the toner density measured and the charged amount of toner thus determined, by referring to the duty-Vpp determination table as described above with reference to FIG. 16.

At this time, in the image forming apparatus 1, the main controller 110 determines the frequency of the AC voltage. The engine controller 120 controls the AC voltage to obtain the frequency thus determined. In addition, the main controller 110 determines the duty and the potential difference Vpp. The engine controller 120 controls the AC voltage to obtain the duty and the potential difference Vpp thus determined. Thus, in the present embodiment, the engine controller 120 serves as an applied voltage controller.

As described above with reference to FIG. 16, the image forming apparatus 1 is configured to measure the toner density and the charged amount of toner within the developing unit 323, to determine the duty and the potential difference Vpp by referring to the duty-Vpp determination table. Alternatively, if the charged amount of toner is measurable, the image forming apparatus 1 may measure the developing gamma and the charged amount of toner within the developing unit 323, to determine appropriate duty and potential difference Vpp by referring to a duty-Vpp determination table that matches the appropriate duty and potential difference Vpp for each combination of the developing gamma and the charged amount of toner as illustrated in FIG. 19.

FIG. 19 is an example of such a duty-Vpp determination table according to an embodiment of the present disclosure.

Such a configuration allows the image forming apparatus 1 to determine the appropriate duty and potential difference Vpp by referring to the duty-Vpp determination table as illustrated in FIG. 19, based on the developing gamma and the charged amount of toner within the developing unit 323.

Alternatively, the image forming apparatus 1 may be configured to measure the developing gamma and the toner density within the developing unit 323 without calculating or predicting the charged amount of toner, to determine appropriate duty and potential difference Vpp by referring to a duty-Vpp determination table that matches the appropriate duty and potential difference Vpp for each combination of the developing gamma and the toner density as illustrated in FIG. 20.

FIG. 20 is an example of such a duty-Vpp determination table according to an embodiment of the present disclosure.

Such a configuration allows the image forming apparatus 1 to determine the appropriate duty and potential difference Vpp by referring to the duty-Vpp determination table as illustrated in FIG. 20, based on the developing gamma and the toner density within the developing unit 323.

It is to be noted that, in FIGS. 16 and 19, a larger charged amount of toner decreases the duty and the potential difference Vpp. This is because a larger charged amount of toner pulls back an increased amount of toner from the photoconductive drum 321 even when the pullback bias and the duty are relatively low, rendering any increase in the duty and the potential difference Vpp that has an impact on the pullback bias unnecessary.

As described above, an image forming apparatus that applies a low-frequency AC voltage as a developing roller to a developing roller reduces the pullback bias and the duty of the developing bias to prevent image failure and the periodic unevenness in image density that may be caused by changes in size of the developing gap due to, e.g., eccentricity of the developing roller and a photoconductive drum. Since a larger charged amount of toner allows the duty and the potential difference Vpp to be decreased, the image forming apparatus 1 enhances prevention of image failure.

Thus, the image forming apparatus 1 is configured to apply a low-frequency AC voltage as a developing bias to the developing roller 323*d*, and to determine the appropriate duty and potential difference Vpp based on the charged amount of toner within the developing unit 323. Accordingly, the image forming apparatus 1 prevents the periodic unevenness in image density due to changes in size of the developing gap, and further prevents image failure. Thus, the image forming apparatus 1 enhances image quality.

As described above as examples, the image forming apparatus 1 is configured to determine the duty and the potential difference Vpp by referring to one of the duty-Vpp determination tables illustrated in FIGS. 16, 19, and 20. Alternatively, the image forming apparatus 1 may be configured to store a plurality of duty-Vpp determination tables illustrated in FIGS. 16, 19, and 20, depending on the usage environment such as temperature and humidity, to selectively use the duty-Vpp determination tables depending on the usage environment such as temperature and humidity. This is because the developing gamma and the charged amount of toner depend on the usage environment such as temperature and humidity.

Such a configuration allows the image forming apparatus 1 to determine the duly and the potential difference Vpp depending on the usage environment. Accordingly, the image forming apparatus 1 prevents the periodic unevenness in image density due to changes in size of the developing gap, and further prevents image failure. Thus, the image forming apparatus 1 enhances image quality.

As described above with reference to FIG. 18 as an example, the image forming apparatus 1 is configured to predict the charged amount of toner within the developing unit 323 based on the developing gamma and the toner density within the developing unit 323. Alternatively, as described above with reference to FIG. 19, the image forming apparatus 1 may be configured to directly measure the charged amount of toner within the developing unit 323.

As described above as an example, the image forming apparatus 1 is configured to determine the appropriate duty and potential difference Vpp for the colors cyan, magenta, yellow, and black. Alternatively, the image forming apparatus 1 may be configured to determine the duty and the potential difference Vpp for at least one of the colors cyan, magenta, yellow, and black that exhibits noticeable unevenness in image density and image failure, and to perform the DC development for the rest of the colors cyan, magenta, yellow, and black that exhibits unnoticeable unevenness in image density and image failure. Such a configuration allows the image forming apparatus 1 to reduce cost.

In the image forming apparatus 1, a target amount of toner to adhere to a recording medium depends on the type of recording medium as the roughness and color of the recording medium generates coloring difference. The target amount of toner may be changed by a manual instruction. It is to be noted that the target amount of toner to adhere to a recording medium is a desired amount of toner to adhere to a recording medium per unit area when a solid image is transferred onto the recording medium.

With regards to the type of recording medium, for example, the target amount of toner to adhere to the recording medium may be 0.45 $mg/cm^2$ for plain paper, 0.4 $mg/cm^2$ for coated paper, 0.5 $mg/cm^2$ for color paper, and 0.8 $mg/cm^2$ for white paper.

With regards to the manual instruction, for example, the target amount of toner to adhere to the recording medium may be changed in a range of from about 0 $mg/cm^2$ to about +0.15 $mg/cm^2$ from a default value for relatively deep color. On the other hand, the target amount of toner to adhere to the recording medium may be changed in a range of from about 0 $mg/cm^2$ to about −0.15 $mg/cm^2$ from the default value for relatively light color.

The image forming apparatus 1 controls the developing potential to control the target amount of toner to adhere to the recording medium. Specifically, the image forming apparatus 1 increases the developing potential to increase the target amount of toner to adhere to the recording medium. By contrast, the image forming apparatus 1 decreases the developing potential to decrease the target amount of toner to adhere to the recording medium.

Figure 21:
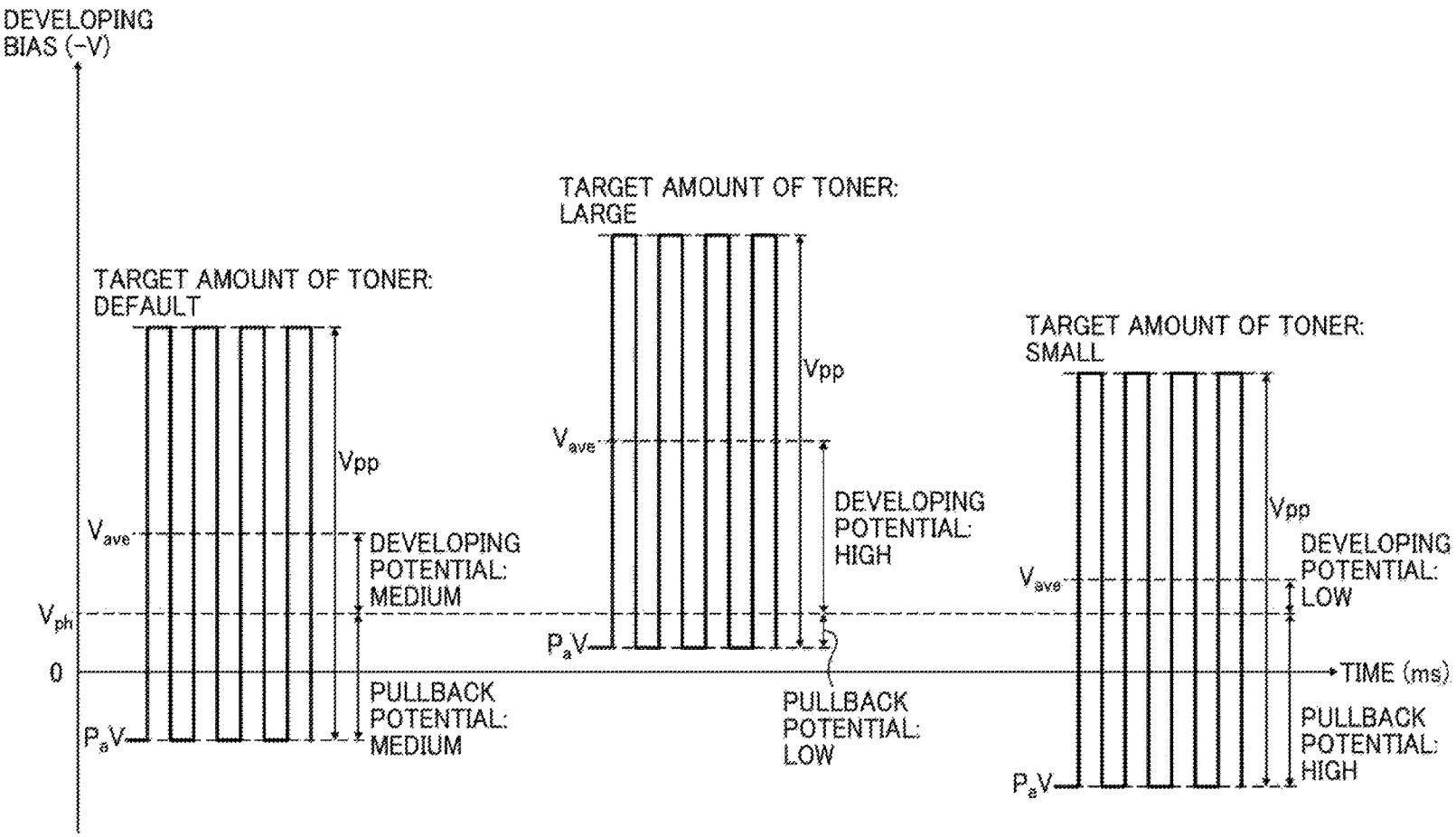
FIG. 21 is a graph illustrating a comparative relationship between developing potential and electric potential of pullback bias.

FIG. 21 is a graph illustrating a comparative relationship between developing potential and electric potential of pullback bias (hereinafter referred to as pullback potential).

It is to be noted that FIG. 21 illustrates a pullback potential as a potential difference between the electric potential $V_{ph}$ at the exposed portion of the photoconductive drum 321 and the maximum voltage $P_aV$ of the developing bias. FIG. 21 illustrates a condition before the target amount of toner to adhere to the recording medium is controlled on the left. Since an average electric potential $V_{ave}$ of the developing roller 323*d* is on a minus side from the electric potential $V_{ph}$ at the exposed portion of the photoconductive drum 321, the electrostatic latent image is developed with toner on the photoconductive drum 321. In the middle of the development zone or developing nip, the toner reciprocates between the carrier on the developing roller 323*d* and the photoconductive drum 321. Nearby the exit of the development zone or developing nip, the toner hops only in the vicinity of the photoconductive drum 321. Accordingly, the unevenness in image density is reduced and image graininess is enhanced, that is, image failure is prevented. However, when the developing potential changes at a constant potential difference Vpp from the condition on the left in FIG. 21, the pullback bias also changes even at the constant potential difference Vpp. As illustrated in the middle in FIG. 21, when the developing potential is increased, the pullback potential is decreased. As a result, the toner is not pulled back, hampering effective prevention of the unevenness in image density. As illustrated on the right in FIG. 21, when the developing potential is decreased, the pullback bias is increased. As a result, the toner is pulled back nearby the exit of the development zone, hampering effective prevention of image failure.

It is to be noted that, in FIG. 21, "$V_{ave}$" represents the average voltage of the AC development, that is, the electric potential of the DC component of the developing bias in the AC development. "$V_{ph}$" represents the electric potential at the exposed portion of the photoconductive drum 321. The charged amount of toner in on the minus side. The low frequency is herein defined as a frequency equal to or less than 10 kHz. The condition illustrated on the left in FIG. 21 is a standard example in which the frequency is 5.3 kHz, the time is 0.189 ms, the duty is 50%, the average voltage $V_{ave}$ is −350V, the potential difference Vpp is 1200V, the exposure potential is 100V, and the developing potential is (|(−350)−(−100)|=250V).

Thus, the image forming apparatus 1 determines the duty and the potential difference Vpp as described with reference to FIGS. 16, 19, and 20. However, the changes in developing potential may hamper effective prevention of the unevenness in image density and image failure.

Hence, the image forming apparatus 1 is configured to change the potential difference Vpp of the developing potential depending on the developing potential.

Figure 22:
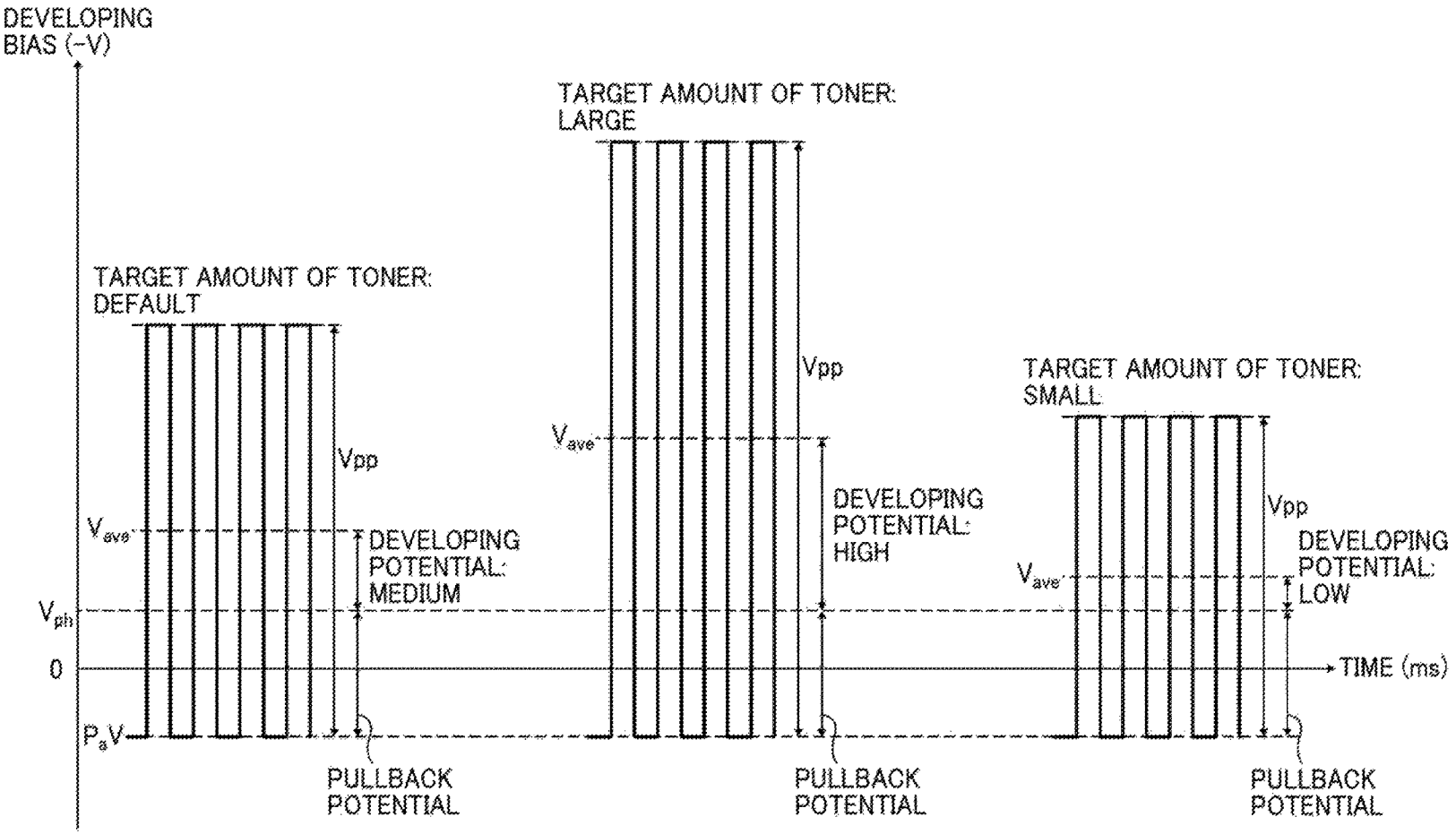
FIG. 22 is a graph illustrating a relationship between developing potential and electric potential of pullback bias in the image forming apparatus of FIG. 1 according to an embodiment of the present disclosure.

FIG. 22 is a graph illustrating a relationship between developing potential and electric potential of pullback bias (i.e., pullback potential) in the image forming apparatus 1 according to an embodiment of the present disclosure.

A condition illustrated on the left in FIG. 22 is identical to the condition illustrated on the left in FIG. 21. Specifically, as illustrated in the middle of FIG. 22, the image forming apparatus 1 increases the potential difference Vpp of the developing bias when the target amount of toner is relatively large, that is, in response to an increase in the developing potential. On the other hand, as illustrated on the right in FIG. 22, the image forming apparatus 1 decreases the potential difference Vpp of the developing bias when the target amount of toner is relatively small, that is, in response to a decrease in the developing potential. Thus, the pullback bias remains constant, without increasing even when the developing potential is relatively low. Consequently, the toner hops only in the vicinity of the photoconductive drum 321 nearby the exit of the development zone, enhancing prevention of image failure and exhibiting an enhanced image graininess.

Such a configuration allows the image forming apparatus 1 to maintain the pullback bias constant, regardless of the target amount of toner to adhere to the recording medium. Accordingly, the image forming apparatus 1 prevents the periodic unevenness in image density due to changes in size of the developing gap, and further prevents image failure. Thus, the image forming apparatus 1 enhances image quality.

Figure 23:
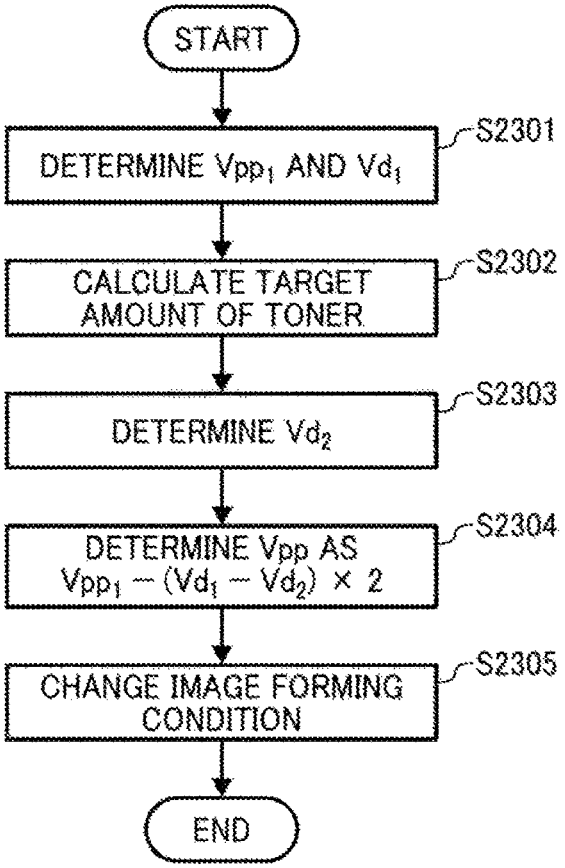
FIG. 23 is a flowchart of a determination process executed by the image forming apparatus of FIG. 1, to determine the potential difference of the developing bias.

Referring now to FIG. 23, a description is given of a determination process executed by the image forming apparatus 1, to determine the potential difference Vpp of the developing bias.

FIG. 23 is a flowchart of the determination process executed by the image forming apparatus of FIG. 1, to determine the potential difference Vpp of the developing bias.

The main controller 110 specifies a developing gamma from a developing potential and an amount of adhering toner measured beforehand. In the measurement beforehand, e.g., a sensor for detecting the amount of adhering toner incorporated in the image forming apparatus 1 detects the amount of adhering toner a plurality of times. The main controller 110 calculates the gradient (i.e., developing gamma) based on the amount of adhering toner for each developing potential. It is to be noted that the developing potential is an absolute difference of an average electric potential of AC development voltage and an electric potential of the electrostatic latent image.

The main controller 110 determines a developing potential $Vd_1$ when the image forming apparatus 1 determines the potential difference Vpp of the developing bias taking into consideration the information on the type of recording medium and the manual instruction. The developing potential $Vd_1$ is a developing potential when the amount of toner to adhere to plain paper is 0.45 mg/cm$^2$ with the developing gamma and no manual instruction is received. As the developing gamma is calculated, the image forming apparatus 1 determines a potential difference $Vpp_1$ in one of the ways described above with reference to FIGS. 18, 19, and 20 in step S2301.

Specifically, in the present embodiment, the main controller 110 serves as a potential difference reference determiner and as a developing potential reference determiner. The developing potential $Vd_1$ is determined as a reference of developing potential whereas the potential difference $Vpp_1$ is determined as a reference of potential difference.

The image forming apparatus 1 determines a target amount of toner to adhere when receiving a print job with the information on the type of recording medium and the manual instruction. The developing potential Vd and the potential difference Vpp remain as the developing potential $Vd_1$ and the potential difference $Vpp_1$, respectively, for a case where the type of recording medium is plain paper and no manual instruction is given. For other cases, the image forming apparatus 1 changes or modifies the developing potential Vd and the potential difference Vpp to, e.g., a developing potential $Vd_2$ and a potential difference $Vpp_2$, depending on the target amount of adhering toner. In step S2302, the main controller 110 calculates the target amount of toner depending on the information on the manual instruction or the information on the type of recording medium to be used. In step S2303, the main controller 110 determines a developing potential for forming an image containing the target amount of toner thus calculated, based on the developing gamma. The developing potential thus determined in step S2303 is herein the developing potential $Vd_2$. Thus, in the present embodiment, the main controller 110 serves as a developing potential modifier.

In step S2304, the main controller 110 determines the potential difference $Vpp_2$ as "$Vpp_2=Vpp_1-(Vd_1-Vd_2)\times 2$", and then defines the potential difference $Vpp_2$ as the potential difference Vpp. In step S2305, the developing potential $Vd_2$ determined in step S2303 is defined as the developing potential Vd, and an image forming condition is changed without changing the pullback bias to achieve the potential difference Vpp thus determined in step S2304. Thus, in the present embodiment, the main controller 110 serves as a potential difference determiner. Thereafter, when an image is formed under the image forming condition thus changed and the print job ends, the potential difference Vpp and the developing potential Vd are defined as the original potential difference $Vpp_1$ and developing potential $Vd_1$, respectively, for a next print job.

As described above, the image forming apparatus 1 is configured to change the potential difference Vpp of the developing potential depending on the developing potential. Specifically, as illustrated in FIG. 22, the image forming apparatus 1 increases the potential difference Vpp of the developing bias without changing the pullback bias when the target amount of toner is relatively large, that is, the developing potential is relatively high. On the other hand, as illustrated on the right in FIG. 22, the image forming apparatus 1 decreases the potential difference Vpp of the developing bias without changing the pullback bias when the target amount of toner is relatively small, that is, the developing potential is relatively low. At this time, the image forming apparatus 1 changes the potential difference Vpp to satisfy an equation of "$Vpp=Vpp_1-(Vd_1-Vd_2)\times 2$".

Such a configuration allows the image forming apparatus 1 to maintain the pullback bias constant, regardless of the target amount of toner. Accordingly, the image forming apparatus 1 prevents the periodic unevenness in image density due to changes in size of the developing gap, and further prevents image failure. Thus, the image forming apparatus 1 enhances image quality.

It is to be noted that, generally, the target amount of toner is changed more frequently when spot color toner such as clear toner and white toner is used than when yellow, cyan, magenta, and black toners are used. This is because, in typical image forming apparatuses, a modeled image is formed using an increased amount of clear toner whereas a bright color image is formed using an increased amount of white toner that covers the original color of the recording medium.

Therefore, the image forming apparatus 1 may be configured to change the potential difference Vpp of the developing bias depending on the developing potential for the image forming unit 320 that changes the amount of toner to adhere, such as spot color, more frequently than in another image forming units 320. Such a configuration allows the image forming apparatus 1 to enhance image quality of an image formed effectively with decreased cost.

The present disclosure has been described above with reference to specific embodiments. It is to be noted that the present disclosure is not limited to the details of the embodiments described above, but various modifications and enhancements are possible without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

Any one of the above-described operations may be performed in various other ways, for example, in an order different from the one described above.

Further, any of the above-described devices or units can be implemented as a hardware apparatus, such as a special-purpose circuit or device, or as a hardware/software combination, such as a processor executing a software program.

Further, as described above, any one of the above-described and other methods of the present disclosure may be embodied in the form of a computer program stored in any kind of storage medium. Examples of storage mediums include, but are not limited to, flexible disk, hard disk, optical discs, magneto-optical discs, magnetic tapes, non-volatile memory cards, read only memory (ROM), etc.

Alternatively, any one of the above-described and other methods of the present disclosure may be implemented by an application specific integrated circuit (ASIC), prepared by interconnecting an appropriate network of conventional component circuits or by a combination thereof with one or more conventional general purpose microprocessors and/or signal processors programmed accordingly.

What is claimed is:

1. An applied voltage control device comprising:

circuitry configured to determine a potential difference between a maximum alternating current development voltage and a minimum alternating current development voltage, depending on a developing potential that is an absolute value of a difference between an average electric potential of an alternating current development and an electric potential of a latent image, so as to maintain a constant maximum voltage of a developing bias in the alternating current development, and control an alternating current development voltage, applied to move a developer from a developer bearer to the latent image, so as to obtain the potential difference determined, wherein the circuitry is further configured to determine a reference of the potential difference, and determine the potential difference depending on the developing potential, based on the reference of the potential difference determined.

2. The applied voltage control device according to claim 1, wherein the circuitry determines the reference of the potential difference to pull back the developer from the latent image to the developer bearer.

3. The applied voltage control device according to claim 1, wherein the circuitry is configured to determine a reference of the developing potential, and modify the developing potential from the reference of the developing potential, depending on a target amount of the developer to adhere to a recording medium, and the circuitry determines the potential difference to be equal to the reference of the potential difference−(the reference of the developing potential−the developing potential modified by the developing potential modifier)×2.

4. The applied voltage control device according to claim 1, wherein the circuitry is configured to increase the potential difference in response to an increase in the developing potential.

5. The applied voltage control device according to claim 1, wherein the circuitry is configured to decrease the potential difference in response to a decrease in the developing potential.

6. An image forming apparatus comprising the applied voltage control device according to claim 1.

7. A method of controlling an applied voltage, the method comprising:

determining a potential difference between a maximum alternating current development voltage and a minimum alternating current development voltage, depending on a developing potential that is an absolute value of a difference between an average electric potential of an alternating current development and an electric potential of a latent image, so as to maintain a constant maximum voltage of a developing bias in the alternating current development;

determining a reference of the potential difference; and controlling an alternating current development voltage, applied to move a developer from a developer bearer to the latent image, so as to obtain the potential difference determined, wherein the determining of the potential difference is determined depending on the developing potential, based on the reference of the potential difference determined.

8. A non-transitory, computer-readable storage medium storing an applied voltage control program which, when executed by a processor, performs a method of controlling an applied voltage, the method comprising:

determining a potential difference between a maximum alternating current development voltage and a minimum alternating current development voltage, depending on a developing potential that is an absolute value of a difference between an average electric potential of an alternating current development and an electric potential of a latent image, so as to maintain a constant maximum voltage of a developing bias in the alternating current development;

determining a reference of the potential difference; and controlling an alternating current development voltage, applied to move a developer from a developer bearer to the latent image, so as to obtain the potential difference determined, wherein the determining of the potential difference is determined depending on the developing potential, based on the reference of the potential difference determined.

9. The applied voltage control device according to claim 1, wherein the circuitry is configured to change the potential difference depending on the developing potential only for an image former associated with a spot color toner, which is different from yellow toner, cyan toner, magenta toner, and black toner.

* * * * *